US008038256B2

(12) United States Patent
Araki et al.

(10) Patent No.: US 8,038,256 B2
(45) Date of Patent: Oct. 18, 2011

(54) DISCHARGING APPARATUS AND REMOVING METHOD

(75) Inventors: Yoshimasa Araki, Kanagawa (JP); Shin-ichiro Takahama, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/535,372

(22) Filed: Aug. 4, 2009

(65) Prior Publication Data

US 2009/0289989 A1 Nov. 26, 2009

Related U.S. Application Data

(63) Continuation of application No. 10/806,156, filed on Mar. 23, 2004, now Pat. No. 7,588,311.

(30) Foreign Application Priority Data

Mar. 24, 2003 (JP) ..... 2003-080204

(51) Int. Cl.
*B41J 2/165* (2006.01)

(52) U.S. Cl. ..... 347/29

(58) Field of Classification Search ..... 347/29–30, 347/84–86

See application file for complete search history.

(56) References Cited

U.S. PATENT DOCUMENTS

| | | | | |
|---|---|---|---|---|
| 4,345,262 | A | 8/1982 | Shirato et al. | 347/10 |
| 4,383,263 | A | 5/1983 | Ozawa et al. | 347/30 |
| 4,410,900 | A | 10/1983 | Terasawa | 347/30 |
| 4,506,277 | A * | 3/1985 | Terasawa | 347/24 |
| 5,625,385 | A | 4/1997 | Suzuki | 347/24 |
| 5,896,143 | A | 4/1999 | Matsui et al. | 347/24 |
| 5,953,026 | A | 9/1999 | Yoshino | 347/36 |
| 5,992,966 | A | 11/1999 | Nitta et al. | |
| 6,000,792 | A | 12/1999 | Koizumi et al. | 347/89 |
| 6,273,545 | B1 | 8/2001 | Oide | |
| 7,048,353 | B2 | 5/2006 | Waller et al. | 347/35 |
| 7,588,311 | B2 * | 9/2009 | Araki et al. | 347/29 |

FOREIGN PATENT DOCUMENTS

| | | | |
|---|---|---|---|
| JP | 1-080544 | A | 3/1989 |
| JP | 5-318753 | A | 12/1993 |
| JP | 06-328703 | A | 11/1994 |
| JP | 10-157153 | A | 6/1998 |
| JP | 11-078050 | A | 3/1999 |
| JP | 11-170573 | A | 6/1999 |
| JP | 11-309873 | A | 11/1999 |
| JP | 2002-286733 | A | 10/2002 |

OTHER PUBLICATIONS

Japanese Office Action dated Nov. 2, 2010, which issued in counterpart Japanese application No. 2004-087076.

* cited by examiner

*Primary Examiner* — Geoffrey Mruk

(74) *Attorney, Agent, or Firm* — Fitzpatrick, Cella, Harper & Scinto

(57) ABSTRACT

When different liquids are charged in a plurality of nozzles, the liquids are drawn by suction or pushed out reliably from the nozzles, so that the liquids collected by suction or pushing out can be reused. For this purpose, a removing unit, which has a cap that operates to cover nozzle discharge ports and to come into tight contact with a head, is provided. Suction is performed from each nozzle separately. Different collection tubes and collection tanks are provided for the removing unit. A liquid having the same liquid composition is accumulated in one collection tank for the same liquid composition via the collection tube of a liquid channel for the same liquid composition.

8 Claims, 29 Drawing Sheets

DISCHARGING APPARATUS AND REMOVING METHOD

This is application is a continuation of U.S. patent application Ser. No. 10/806,156, filed Mar. 23, 2004, now U.S. Pat. No. 7,588,311 B2.

FIELD OF THE INVENTION

The present invention relates to a discharging apparatus which can discharge many types of different liquids from a nozzle. The discharging apparatus includes, in addition to a printing apparatus such as a printer which prints on a to-be-printed member by discharging ink from a nozzle, apparatuses in general having a function of discharging a liquid, e.g., a DNA chip manufacturing apparatus which spots on a DNA chip by discharging many types of probe solutions from a nozzle.

In such discharging apparatuses, the present invention particularly relates to a technique for removing a medium such as bubbles and dust in the nozzle.

BACKGROUND OF THE INVENTION

As a method of printing on a to-be-printed member, an inkjet scheme is available which prints by discharging liquid droplets from a nozzle formed in a head. Among those that employ this scheme, a printer that prints a color image on paper is best known. The inkjet print scheme is applied not only to a printer but also to manufacturing apparatuses such as a color filter manufacturing apparatus, a DNA chip manufacturing apparatus, and the like because it enables a small liquid droplet to land at a predetermined position.

A conventional printer employing the inkjet scheme will be described with reference to FIGS. 24, 25, 26, 27, 28, and 29.

First, the appearance of the conventional inkjet printer will be described with reference to FIGS. 24, 25, and 26.

FIG. 24 is a front view of the conventional inkjet printer, FIG. 25 is a plan view of the same, and FIG. 26 is a side view of the same. Referring to FIG. 24, the outer appearance of a main body 25 is formed of a case 24 and cover 23. The case 24 has a paper feed port 27. As shown in FIG. 25 which is a plan view of the inkjet printer, the cover 23 is connected to the case 24 through hinges 26. As shown in FIG. 26 which is a side view of the inkjet printer, the cover 23 pivots in directions A, as it is connected to the case 24 through the hinges 26.

FIG. 27 is a sectional view taken along the line B-B of FIG. 24, and FIG. 28 is a sectional view taken along the line C-C of FIG. 26. As shown in FIG. 27, a carriage 1 is attached, through a belt fixing portion 5, to a belt 4 attached to a pulley 3 to which the driving force from a main scanning motor 2 is transmitted. When the main scanning motor 2 is driven, the carriage 1 moves in directions D. At this time, the carriage 1 moves as it is supported by a main rail 28 and subrail 29. Ink cartridges for storing ink are mounted on the carriage 1. The number of ink colors is four, i.e., Y (yellow), M (magenta), C (cyan), and BK (black), and the number of ink cartridges, although not shown, is also four.

As shown in FIG. 28, a head 6 attached to the carriage 1 is capped with a cap 7 when it does not print. The head 6 has 256 nozzles for each color, so that it can discharge inks of four different colors. A wiper 8 which cleans the head 6 after printing is attached in a wiper case 9, and the wiper case 9 is supported by a support plate 10. The support plate 10 is attached to a side plate (R) 11. A spare discharge box 12 is arranged next to the wiper case 9. The spare discharge box 12 receives the ink which is discharged from the head 6 before printing to hold the meniscus of the nozzles of the head 6 at a constant level. The spare discharge box 12 is attached to the support plate 10, and the support plate 10 is attached to the side plate (R) 11.

A waste liquid tube 14 is attached to the spare discharge box 12, and is connected to a waste liquid absorber 13. Thus, the ink discharged from the head 6 into the spare discharge box 12 flows through the waste liquid tube 14 and is absorbed by the waste liquid absorber 13. The cap 7 is connected to a suction pump (not shown) through a suction tube 21. After the cap 7 is brought into tight contact with the head 6, the suction pump is actuated, so that small dust, bubbles, and inks with high viscosities are drawn by suction from all the nozzles (256 nozzles for each color) formed in the head 6 (One function of the discharge apparatus for removing a medium such as small dust in a nozzle is generally called a recovery unit portion hereinafter).

FIG. 29 is a sectional view, taken along the line E-E of FIG. 28, and shows a case wherein the carriage 1 has moved to the left from the sectional line E-E in FIG. 28 and a printing sheet 15 is inserted. The printing sheet 15 is inserted in a direction F and is delivered in a direction G. When the printing sheet 15 is inserted in the direction F, it is clamped between a manual feed roller 17 and driven roller 16, and is fed in a direction H by them. After that, the printing sheet 15 passes on a platen 20, is clamped between a feed roller 19 and driven feed roller 18, is fed in the direction H, and is delivered through a delivery port 22. When the printing sheet 15 is present on the platen 20, the head 6 attached to the carriage 1 discharges ink onto the printing sheet 15, thus forming an image on the printing sheet 15.

As described above, in the discharging apparatus such as the conventional inkjet printer, inks of different colors from the nozzles are drawn by suction with one cap 7.

Hence, in supplying different inks to the plurality of nozzles, when some nozzle is left without being injected with any ink, if suction is performed from all the nozzles simultaneously by using one cap that covers the plurality of nozzles entirely, as in the prior art described above, a problem arises in that air is undesirably drawn by suction from the nozzle in which no ink has been injected, and the ink cannot be drawn by suction from the nozzle injected with the ink.

After suction, since all the liquids are mixed in one tank, the collected liquid mixture forms a waste liquid, and cannot be used again in any other way. In other words, suction which is performed to improve the quality of printing leads to a mass disposal of valuable liquids. As a result, the cost necessary for using the discharging apparatus increases.

SUMMARY OF THE INVENTION

The present invention has been made in view of the above respects, and can provide a discharging apparatus that can discharge many types of different liquids from a nozzle, in which when the liquids are supplied to the respective nozzles, even if some nozzle is left without being injected with any liquid, a medium such as small dust, bubbles, and liquids with increased viscosities can be removed reliably from the respective nozzles.

The present invention can also provide a discharging apparatus that enables the removed used liquid to be used again.

In order to achieve the above, the discharging apparatus according to the present invention can have the following arrangement.

That is, a discharging apparatus having a discharge head in which a plurality of discharge nozzles are arranged to discharge a liquid supplied from supply ports through discharge ports, comprises removing means for removing a medium in the discharge nozzles by applying a pressure difference between the supply ports and discharge ports of the discharge nozzles, the removing means further comprising a cap member which operates to cover a predetermined one of the supply ports or discharge ports, when removing the medium in the discharge nozzles, so as to come into tight contact with the discharge head.

Furthermore, the above-described removing means generates a negative pressure in the discharge ports, with the discharge ports being covered by the cap member, and removes the medium in the discharge nozzles by suction through the member.

Furthermore, the above-described removing means generates a positive pressure in the supply ports, with the supply ports being covered by the cap member, and removes by pushing out the medium in the discharge nozzles from the discharge ports.

Furthermore, when removing the medium in the discharge nozzles, the cap member operates to come into tight contact with the discharge head so as to cover only an arbitrary one of the supply ports or discharge ports without coming into contact with any adjacent one of the supply ports or discharge ports.

Furthermore, the plurality of discharge nozzles are formed such that some of the plurality of discharge nozzles discharge liquids having different liquid compositions, and the removing means accumulates the liquids removed from the discharge nozzles, such that a liquid having the same liquid composition is accumulated together.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

First Embodiment

The first embodiment of the present invention will be described with reference to FIGS. 1 to 8.

A recovery unit portion which forms a discharging apparatus according to this embodiment will be described first. In the discharging apparatus, the recovery unit portion may be formed integrally with a portion that forms a discharging function such as nozzles, or may be formed as a unit separately.

<Arrangement of Recovery Unit Portion>

Figure 1:
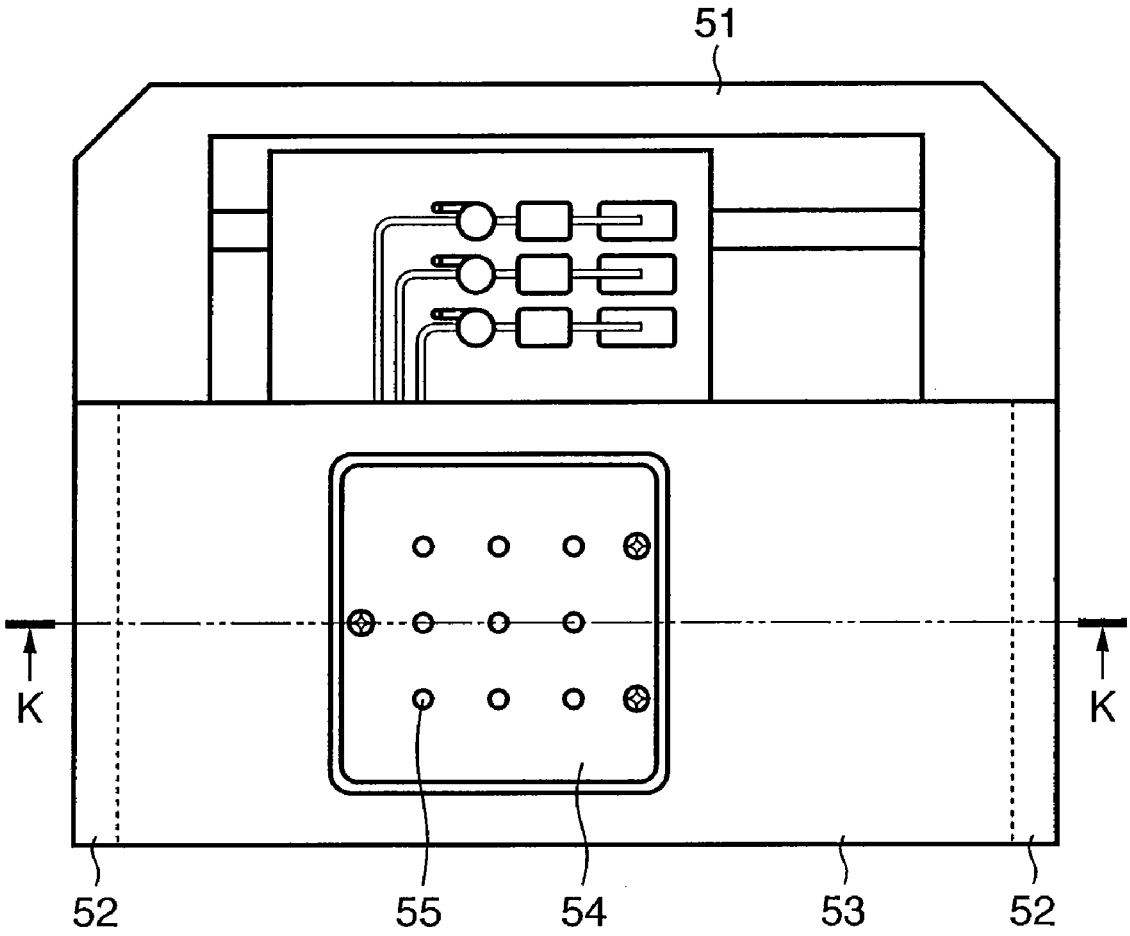
FIG. 1 is a plan view of a recovery unit portion according to the first embodiment of the present invention.

FIG. 1 is a plan view of the recovery unit portion of the discharging apparatus according to the first embodiment of the present invention. In this embodiment, the recovery unit portion is formed separately from the discharging apparatus. Side plates 52 are arranged on a base plate 51, and a head plate 53 is attached on the side plates 52. A head 54 is attached to the head plate 53 with machine screws. The head 54 has nine liquid supply ports 55. The respective liquid supply ports 55 communicate with different nozzles. Different liquids are injected into the respective liquid supply ports 55. Hence, the respective nozzles discharge different liquids.

Figure 2:
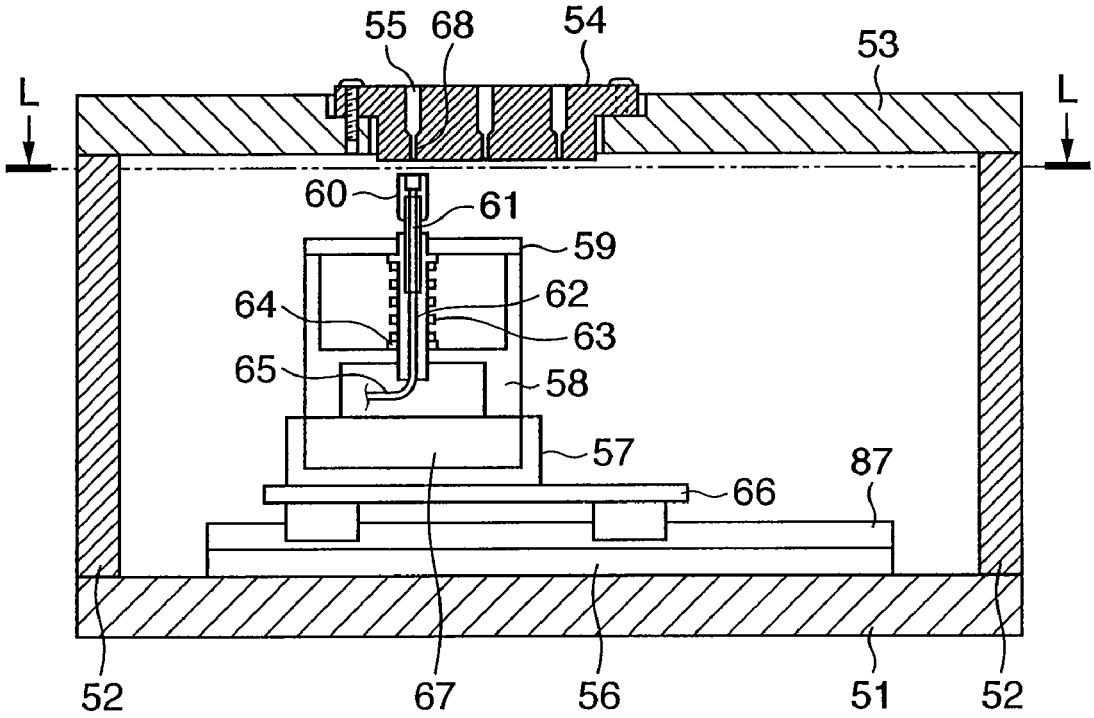
FIG. 2 is a sectional view taken along the line K-K of FIG. 1.

FIG. 2 is a sectional view taken along the line K-K of FIG. 1. The head 54 has nozzles 68. An X stage 56 is mounted on the base plate 51. The X stage 56 has rails 87. An X stage moving portion 66 moves on the rails 87 to the left or right. A Z stage 57 is attached to the X stage moving portion 66. A Z stage moving portion 67 movably arranged on the Z stage 57 moves vertically with respect to the Z stage 57. A cap base 58 is attached to the Z stage moving portion 67. A cap plate 59 is attached to the cap base 58. Caps 60 are arranged at positions opposing the nozzles 68. The caps 60 are made of rubber members. The caps 60 are pressed into cap pipes 61. When the cap pipes 61 are made of flexible members so that they can come into tight contact with the head 54, the caps 60 need not be used. In this case, that portion of each cap pipe 61 which can come into tight contact with the head 54 can approach a corresponding nozzle 68 without coming into contact with any other nozzle 68. The suction port of each cap pipe 61 is larger than the opening of each nozzle 68. Even if a nozzle adjacent to a nozzle 68 from which suction is to be performed has been injected with no ink, the liquid in the nozzle 68 from which suction is to be performed can be drawn by suction reliably without being adversely affected by the adjacent nozzle.

The cap pipes 61 are adhered to cap joints 62. The cap joints 62 can move with respect to the cap base 58. The cap joints 62 are positioned as they are inserted in holes formed in the cap plate 59. Cap springs 63 are mounted on the outer surfaces of the cap joints 62, respectively. Cap washers 64 are interposed between the cap springs 63 and cap base 58. Tubes 65 are adhered to the cap joints 62.

When the Z stage moving portion 67 is moved upward, the caps 60 come into contact with the head 54. When the Z stage moving portion 67 is moved further upward, the cap base 58 and cap washers 64 move upward. As a result, the cap springs 63 are compressed and the caps 60 deflect, so that the caps 60 and head 54 come into tight contact with each other. Then, pumps communicating with the tubes 65 are actuated. The liquids are thus drawn by suction from the nozzles 68 through the caps 60. When the liquids are drawn by suction from the nozzles 68, small dust, bubbles, and liquids with high viscosities in the nozzles 68 are removed.

Subsequently, when the Z stage moving portion 67 is moved downward, the caps 60 separate from the head 54.

When the X stage moving portion 66 is moved to the right in FIG. 2, the suction operation described above can be performed from the two other nozzles 68.

Figure 3:
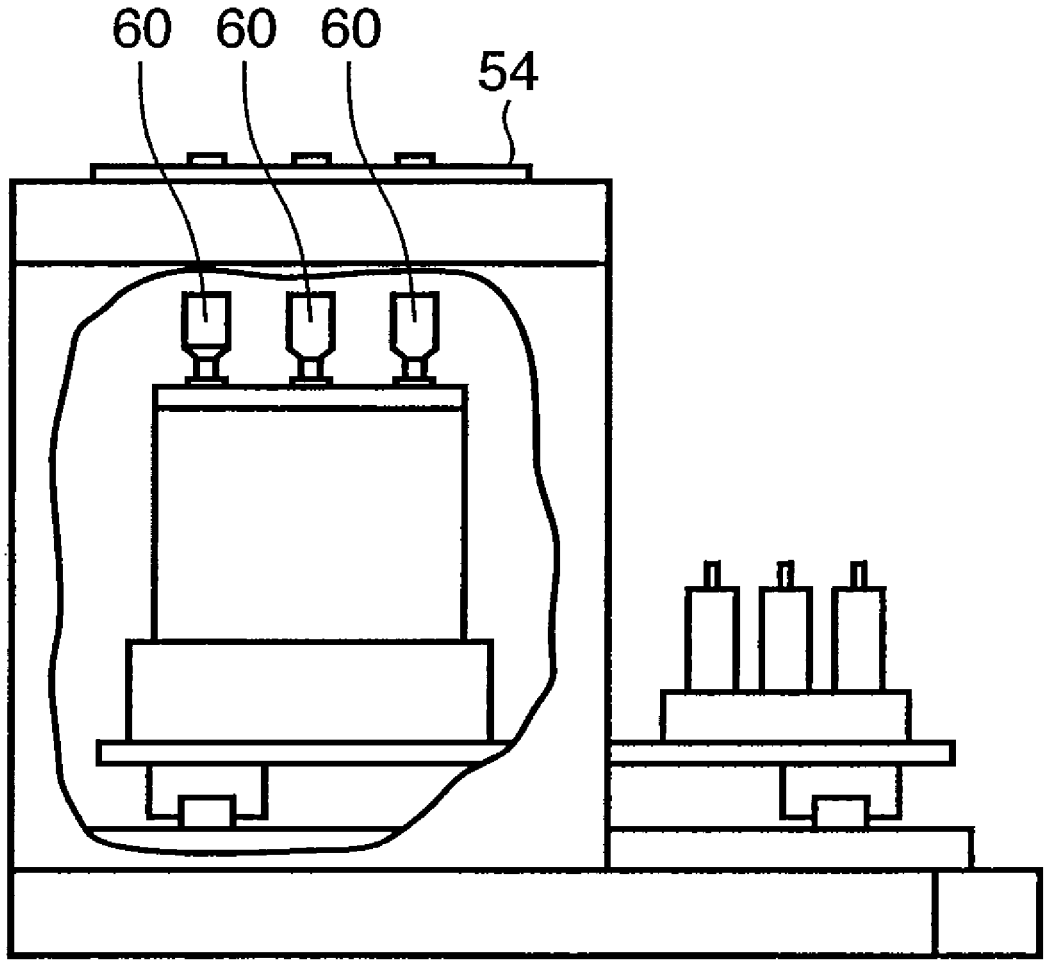
FIG. 3 is a right side view of the recovery unit portion according to the first embodiment of the present invention.

FIG. 3 is a right side view of FIG. 1. As shown in FIG. 3, the caps 60 include three caps 60.

Figure 4:
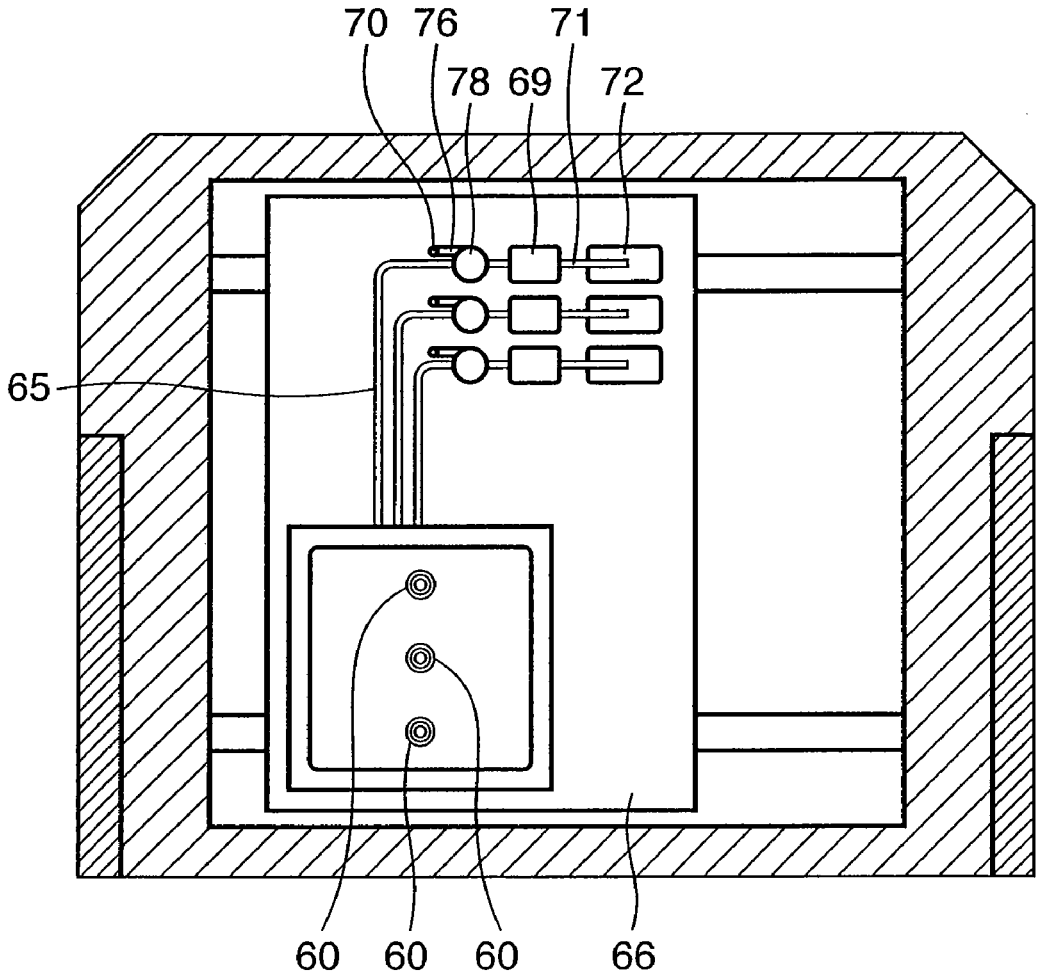
FIG. 4 is a sectional view taken along the line L-L of FIG. 2.

FIG. 4 is a sectional view taken along the line L-L of FIG. 2. The tubes 65 communicate with the caps 60 and are connected to atmosphere valves 78, respectively. The atmosphere valves 78 are three-way valves.

One connecting portion of each atmosphere valve 78 is connected to an atmosphere tube 76. The distal end of the atmosphere tube 76 forms an atmosphere port 70, and is open to the atmosphere. Another connecting portion of the atmosphere valve 78 is connected to a pump 69 through a tube. A waste liquid tube 71 is connected to the pump 69. The other end of the waste liquid tube 71 is connected to a waste liquid tank 72. One atmosphere valve 78, one pump 69, and one waste liquid tank 72 are provided to each cap 60.

<Arrangement of Head>

Figure 5:
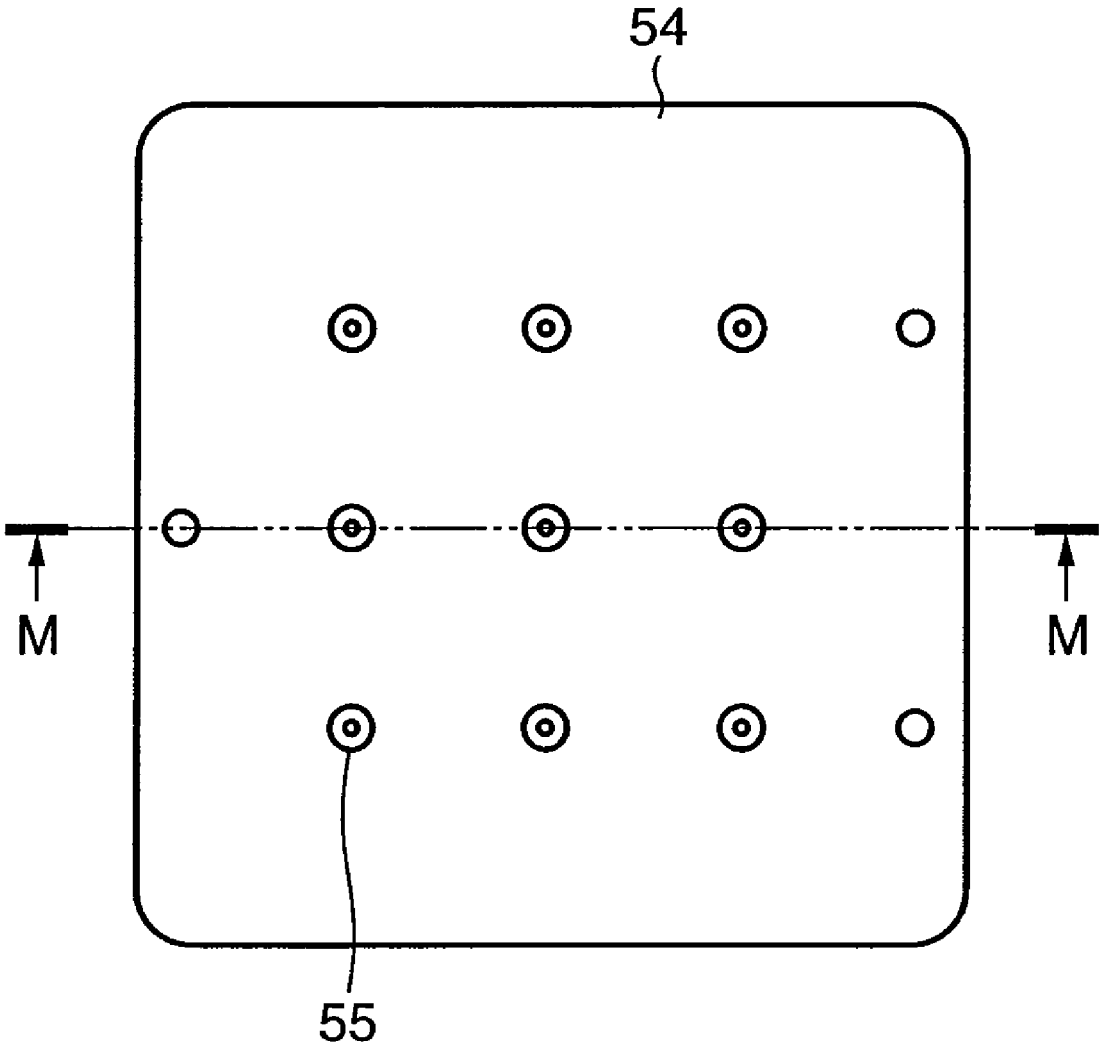
FIG. 5 is a plan view of a head.
Figure 6:
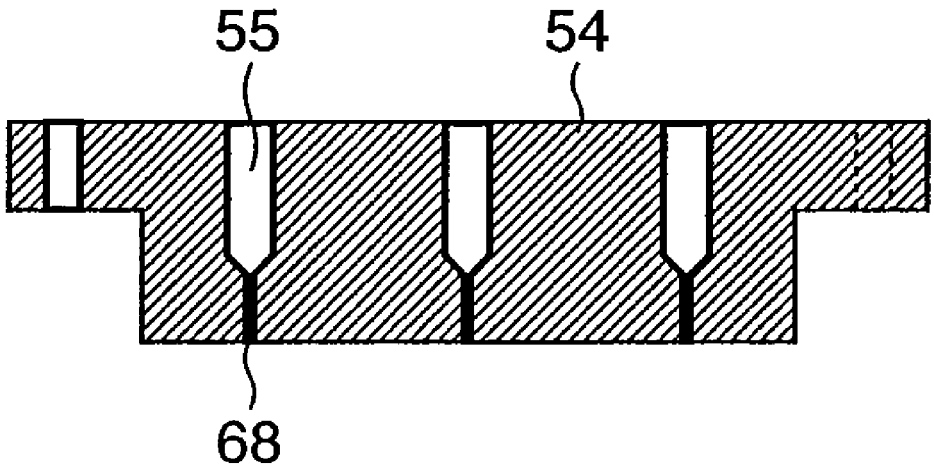
FIG. 6 is a sectional view taken along the line M-M of FIG. 5.

FIG. 5 is a plan view of the head 54 alone. As described above, the head 54 has nine liquid supply ports 55. FIG. 6 is a sectional view taken along the line M-M of FIG. 5. (As described above, the head 54 has the nozzles 68, and the respective liquid supply ports 55 communicate with the different nozzles 68.

The head 54 has an electrothermal transducer which generates heat energy for liquid discharge. The liquid is discharged from a discharge port formed in the head 54 by utilizing film boiling caused by the heat energy applied by the electrothermal transducer.

<Operation of Recovery Unit Portion>

Figure 7:
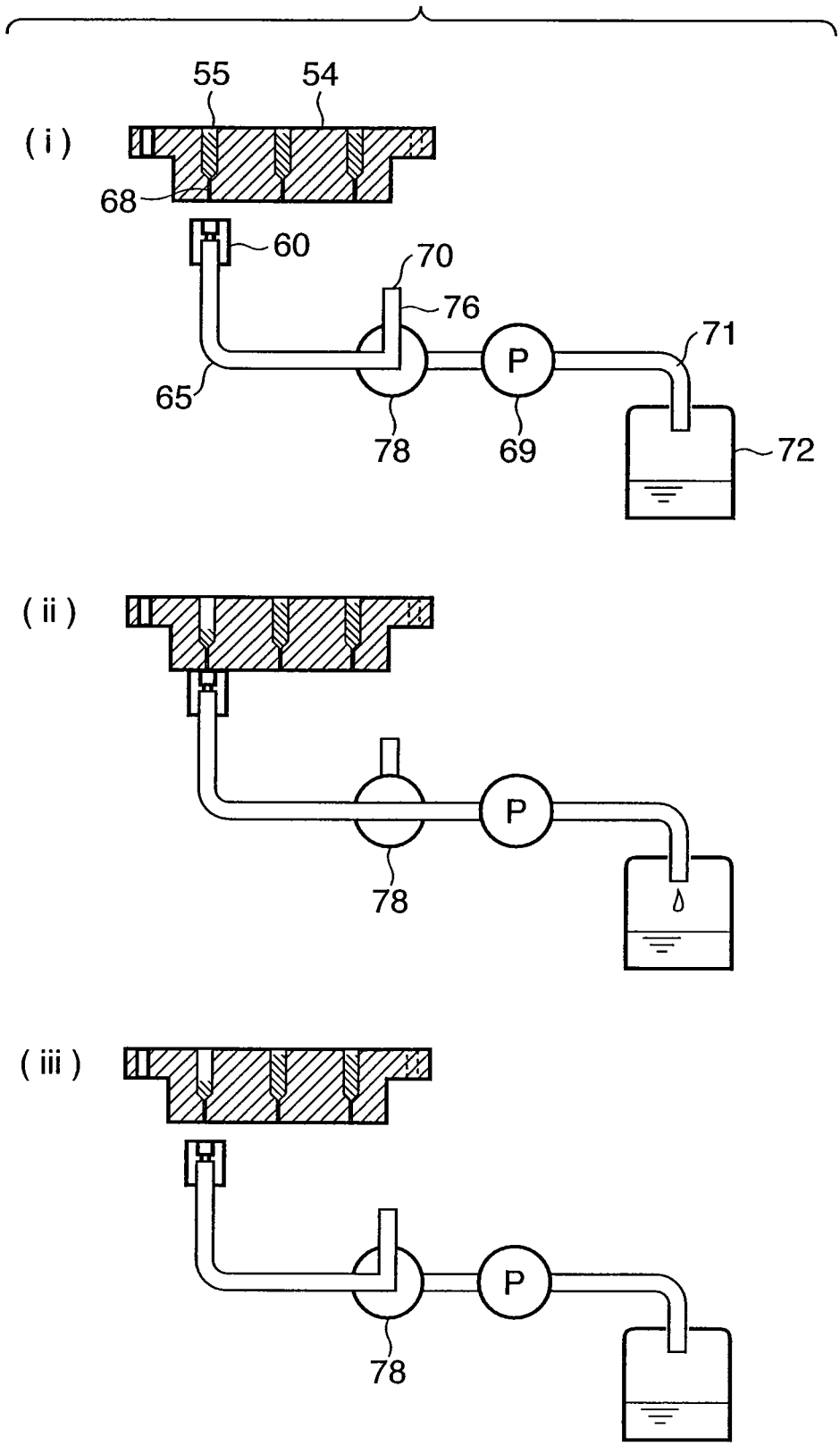
FIG. 7 is a view showing states of the recovery unit portion according to the first embodiment of the present invention.

FIG. 7 shows flow channel diagrams (i), (ii), and (iii) of liquid suction from the nozzles 68 formed in the head 54. In FIG. 7, (i) represents a state in the wait mode, (ii) represents a state in the suction mode, and (iii) represents a state in the cap release mode.

In the wait mode ((i)), different liquids have been injected into the liquid supply ports 55. The caps 60 are separate from the head 54. Each cap 60 can approach a corresponding nozzle 68 without coming into contact with any other nozzle 68. The suction port of each cap 60 is larger than that of each nozzle 68. The tubes 65 communicating with the caps 60 are connected to the atmosphere valves 78. In the wait mode, the tubes 65 communicate with the atmosphere tubes 76 through the atmosphere valves 78. The atmosphere ports 70 of the atmosphere tubes 76 are open to the atmosphere.

In the suction mode ((ii)), the caps 60 are in tight contact with the head 54. The atmosphere valves 78 are electromagnetic valves, and their connecting portions to communicate can be switched by an electrical signal. After the caps 60 come into tight contact with the head 54, the atmosphere valves 78 operate to connect the tubes 65 and pumps 69 to each other. After that, the pumps 69 are operated, so that the liquids are drawn by suction from the nozzles 68 through the caps 60. As a result, the drawn liquids are discharged from the waste liquid tubes 71 into the waste liquid tanks 72.

In the cap release mode ((iii)), after the operation of the pumps 69 is completed, the atmosphere valves 78 are operated so that the tubes 65 and atmosphere tubes 76 communicate with each other. After that, the caps 60 are moved downward, thereby separating them from the head 54.

After the operations of (i), (ii), and (iii) are completed, the X stage moving portion 66 is operated to move the caps 60, and the same operations of (i), (ii), and (iii) are performed. Thus, the liquids can be drawn by suction from all the nozzles 68. Even when the number of nozzles 68 increases, if this arrangement is built more in accordance with the number of nozzles, the same operation can be performed.

Also, the liquid can be drawn by suction from only some of the plurality of nozzles 68. Regarding a method for this, when the cap 60 is in contact with that nozzle 68 from which the liquid is not to be drawn by suction, the corresponding atmosphere valve 78 and pump 69 are not operated in the above operations of (ii) and (iii). When the caps 60 are in contact with those nozzles 68 from which the liquids are to be drawn by suction, the above operations of (i), (ii), and (iii) are performed. Then, the liquid can be drawn by suction from only some nozzles 68.

Alternatively, caps 60 in the same number as those of the nozzles 68 may be provided at positions corresponding to the nozzles 68, and atmosphere valves 78, pumps 69, waste liquid tanks 72, and the like may be provided to correspond to the caps 60. Then, no X stage moving portion 66 need be provided, and the liquid can be drawn by suction from all or some of the nozzles 68.

<Arrangement of Discharging Apparatus>

Figure 8:
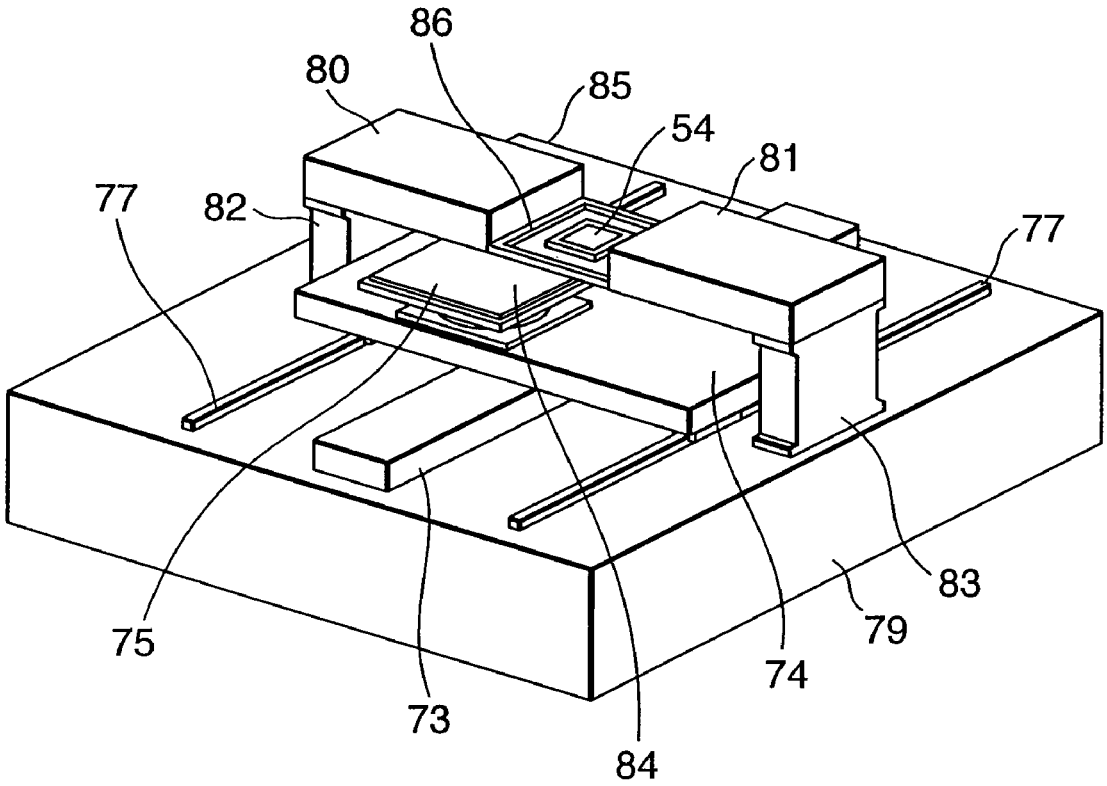
FIG. 8 is a perspective view of a discharging apparatus according to the first embodiment of the present invention.

The discharging apparatus according to this embodiment will be described. FIG. 8 is a perspective view of the discharging apparatus.

A Y-axis stage 73 and guide rails 77 are fixed on a surface plate 79 parallel to each other. An X-axis stage 74 is attached to the moving portions of the Y-axis stage 73 and guide rails 77, so the X-axis stage 74 can move in the Y-axis direction. A chuck 75 is fixed to the moving portion of the X-axis stage 74. The chuck 75 is connected to a pump (not shown) through a tube. When the pump takes in air by suction, a to-be-printed member 84 is chucked by the chuck 75. Support columns 82 and 83 are fixed on the surface plate 79, and bridges 80 and 81 are fixed to the support columns 82 and 83, respectively. The bridges 80 and 81 are fixed to each other through a stay 85. Thus, the strength of the structure consisting of the support columns 82 and 83 and bridges 80 and 81 can be held. A head mounting table 86 is fixed between the bridges 80 and 81. The head 54 is fixed to the head mounting table 86.

In the recovery unit portion (not shown) which forms the discharging apparatus, after a medium such as small dust, bubbles, and liquids with increased viscosities is removed, liquids are injected into the respective nozzles. The Y-axis stage 73 and X-axis stage 74 are operated, and the head 54 discharges the liquids, so that the liquids are discharged to predetermined positions of the to-be-printed member 84.

As is apparent from the above description, in the discharging apparatus according to this embodiment, the recovery unit portion which forms the discharging apparatus has the caps that operate to cover the discharge ports of predetermined nozzles, when the medium in the nozzles is to be removed, so as to come into tight contact with the head. Even if a nozzle adjacent to a nozzle 68 through which suction is to be performed has not been injected with any liquid, the liquid or the like in the nozzle 68 through which suction is to be performed can be drawn by suction reliably without being adversely affected by this adjacent nozzle.

Second Embodiment

In the first embodiment, the liquids drawn by suction from the respective nozzles are collected in the waste liquid tank. However, the present invention is not limited to this, but the liquids drawn by suction can be collected such that they can be reused.

Hence, in this embodiment, of the recovery unit portion which forms the discharging apparatus according to the first embodiment, that portion (to be referred to as "liquid collecting portion") which collects the waste liquid will be described in detail.

Figure 9:
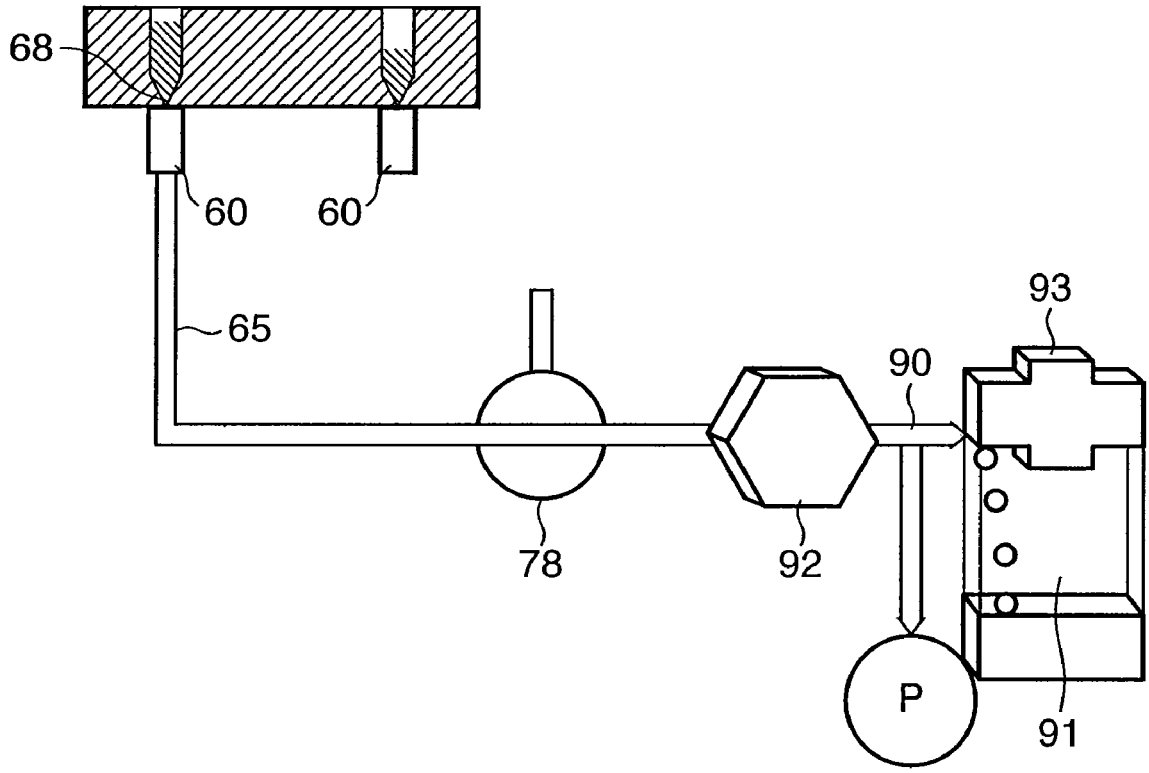
FIG. 9 is a detailed diagram of a liquid collection portion in a recovery unit portion according to the second embodiment of the present invention.

FIG. 9 is a detailed diagram of the liquid collection portion of the recovery unit portion according to this embodiment. Reference numerals 60 denote caps; 90, a liquid collection tube for ensuring a flow channel for the collection liquid; and 91, a liquid collection/storage tank, respectively. The tube 90 and tank 91 correspond to the waste liquid tubes 71 and waste liquid tanks 72 of FIG. 7. According to the characteristic feature of the second embodiment, a liquid that can be used again is cleaned and collected through a filtration unit 92 and deaeration unit 93. The clean liquid may be manually provided from the liquid collection/storage tank 91 to a liquid supply port through which ink is to be supplied, or may be automatically provided with a pump such as an ink supply unit (not shown). With this system, each liquid is cleaned and reused. This system can be realized because it separates and collects used liquid.

In this manner, if the used liquids can be reused, when a very expensive liquid, e.g., a probe solution used in DNA chip manufacture, is to be used, a remarkable effect can be obtained. More specifically, if large amounts of liquids produced by suction performed for improving the quality of printing can be reused, the cost necessary for the manufacture of the DNA chip can be reduced greatly.

Third Embodiment

In the first and second embodiments, the recovery unit portion in the discharging apparatus removes the liquids or the like in the nozzles by suction. However, the present invention is not limited to this. A gas may be injected through the supply ports of the nozzles and may push out the liquids or the like in the nozzles, thereby removing the liquids or the like. The recovery unit portion of this embodiment will be described with reference to FIGS. 10 to 12.

<Arrangement of Recovery Unit Portion>

Figure 10:
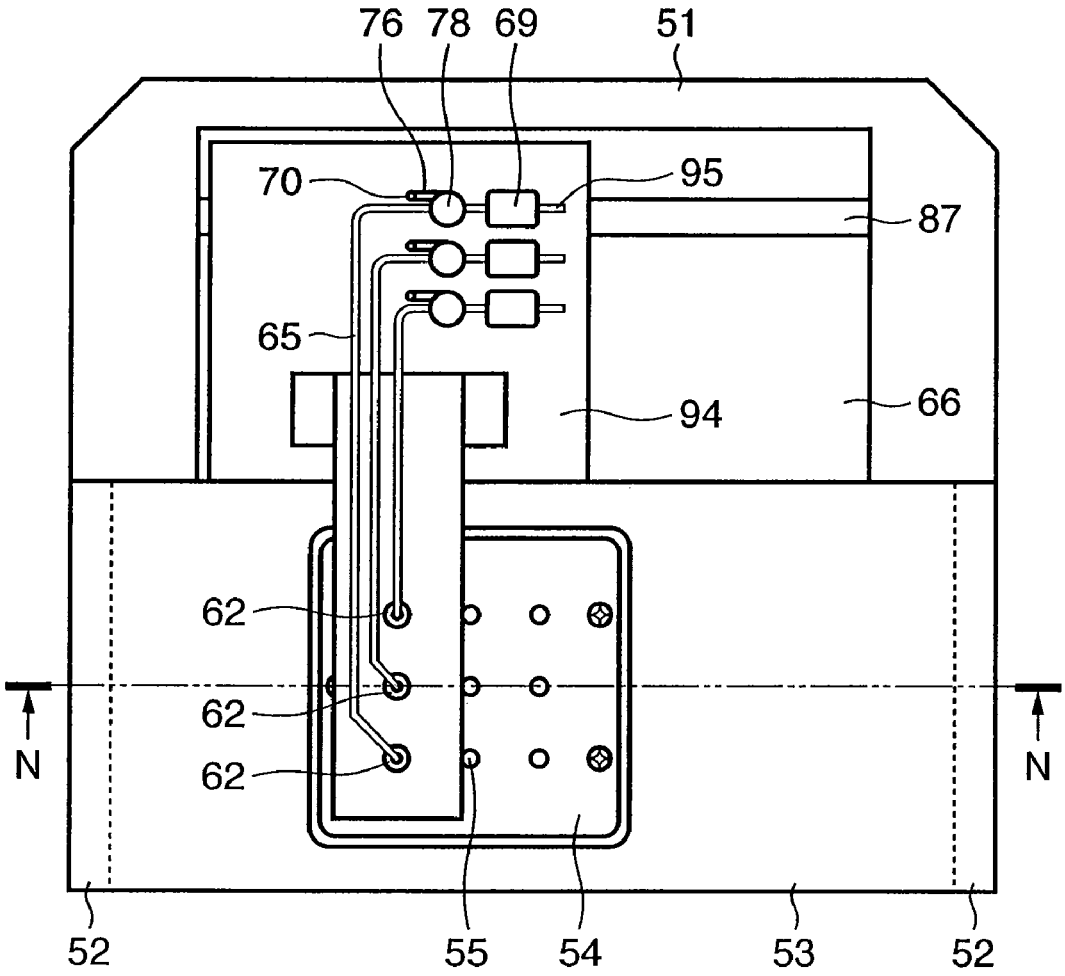
FIG. 10 is a plan view of a recovery unit portion according to the third embodiment of the present invention.

FIG. 10 is a plan view of the recovery unit portion which forms the discharging apparatus according to this embodiment. In this embodiment, the recovery unit portion is formed as a unit separate from a portion that forms a discharging function such as nozzles, in the same manner as in the first embodiment.

Side plates 52 are arranged on a base plate 51, and a head plate 53 is attached on the side plates 52. A head 54 is attached to the head plate 53 with machine screws. The head 54 has nine liquid supply ports 55. The respective liquid supply ports 55 communicate with different nozzles. Different liquids are injected into the respective liquid supply ports 55. Hence, the respective nozzles discharge different liquids.

Figure 11:
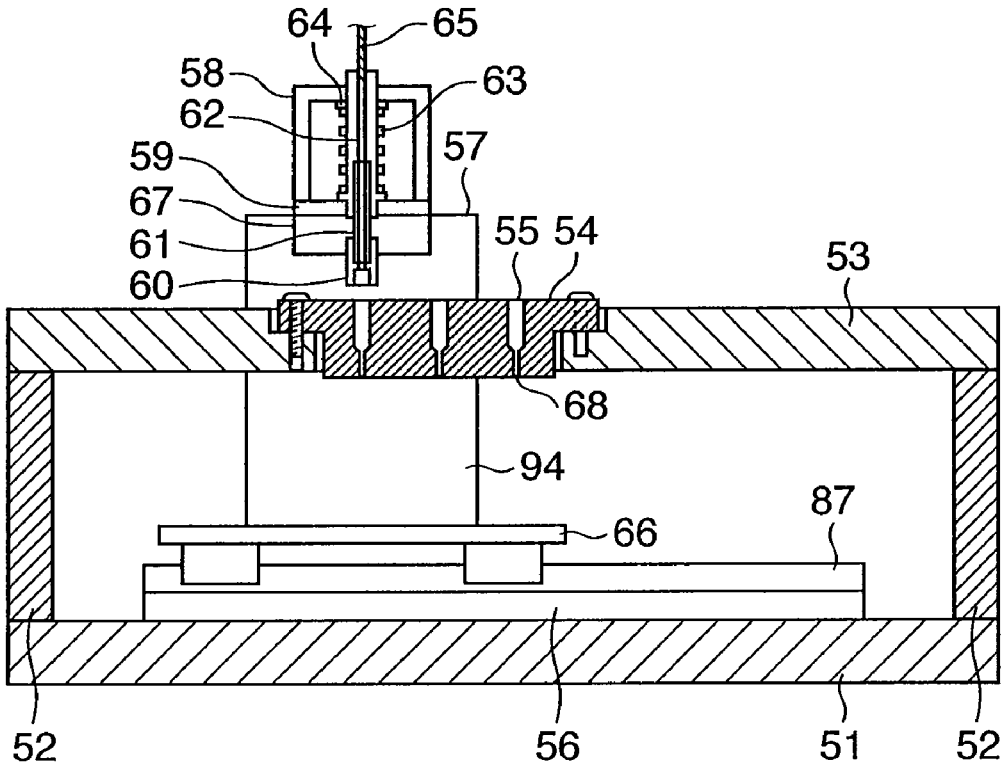
FIG. 11 is a sectional view taken along the line N-N of FIG. 10.

FIG. 11 is a sectional view taken along the line N-N of FIG. 10. The head 54 has nozzles 68. An X stage 56 is mounted on the base plate 51. The X stage 56 has rails 87. An X stage moving portion 66 moves on the rails 87 to the left or right. A support plate 94 is arranged on the X stage moving portion 66. A Z stage 57 is attached to the support plate 94. A Z stage moving portion 67 movably arranged on the Z stage 57 moves vertically with respect to the Z stage 57.

A cap base 58 is attached to the Z stage moving portion 67. A cap plate 59 is attached to the cap base 58. Caps 60 are arranged at positions opposing the nozzles 68.

The caps 60 are formed of rubber members, and are pressed into cap pipes 61. When the cap pipes 61 are formed of flexible members so that they can come into tight contact with the head 54, the caps 60 need not be used. In this case, that portion of each cap pipe 61 which can come into tight contact with the head 54 can approach a corresponding liquid supply port 55 without coming into contact with any other liquid supply port 55. The injection port of each cap pipe 61 can be hermetically connected to the corresponding liquid supply port 55.

The cap pipes 61 are adhered to cap joints 62. The cap joints 62 can move with respect to the cap base 58. The cap joints 62 are positioned as they are inserted in holes formed in the cap plate 59. Cap springs 63 are mounted on the outer surfaces of the cap joints 62, respectively. Cap washers 64 are interposed between the cap springs 63 and cap base 58. Tubes 65 are adhered to the cap joints 62.

When the Z stage moving portion 67 is moved downward, the caps 60 come into contact with the head 54. When the Z stage moving portion 67 is moved further downward, the cap base 58 and cap washers 64 move downward. As a result, the cap springs 63 are compressed and the caps 60 deflect, so that the caps 60 and head 54 come into tight contact with each other. Then, pumps communicating with the tubes 65 are actuated. A gas is thus injected into the liquid supply ports 55 through the caps 60. When the gas is injected into the liquid supply ports 55, a medium in the nozzles 68 such as small dust, bubbles, and liquids with high viscosities is pushed out from the nozzles 68.

Subsequently, when the Z stage moving portion 67 is moved upward, the caps 60 separate from the head 54. When the X stage moving portion 66 is moved to the right in FIG. 11, the injecting operation described above can be performed from the two other liquid supply ports 55.

As shown in FIG. 10, the tubes 65 are adhered to the respective cap joints 62, and the tubes 65 are connected to atmosphere valves 78, respectively. The atmosphere valves 78 are three-way valves.

One connecting portion of each atmosphere valve 78 is connected to an atmosphere tube 76. The distal end of the atmosphere tube 76 forms an atmosphere port 70, and is open to the atmosphere. Another connecting portion of the atmosphere valve 78 is connected to a pump 69 through a tube. The pump 69 is connected to a pump tube 95. The other end of the pump tube 95 is open to the atmosphere. One atmosphere valve 78 and one pump 69 are provided to each cap joint 62.

<Operation of Recovery Unit Portion>

Figure 12:
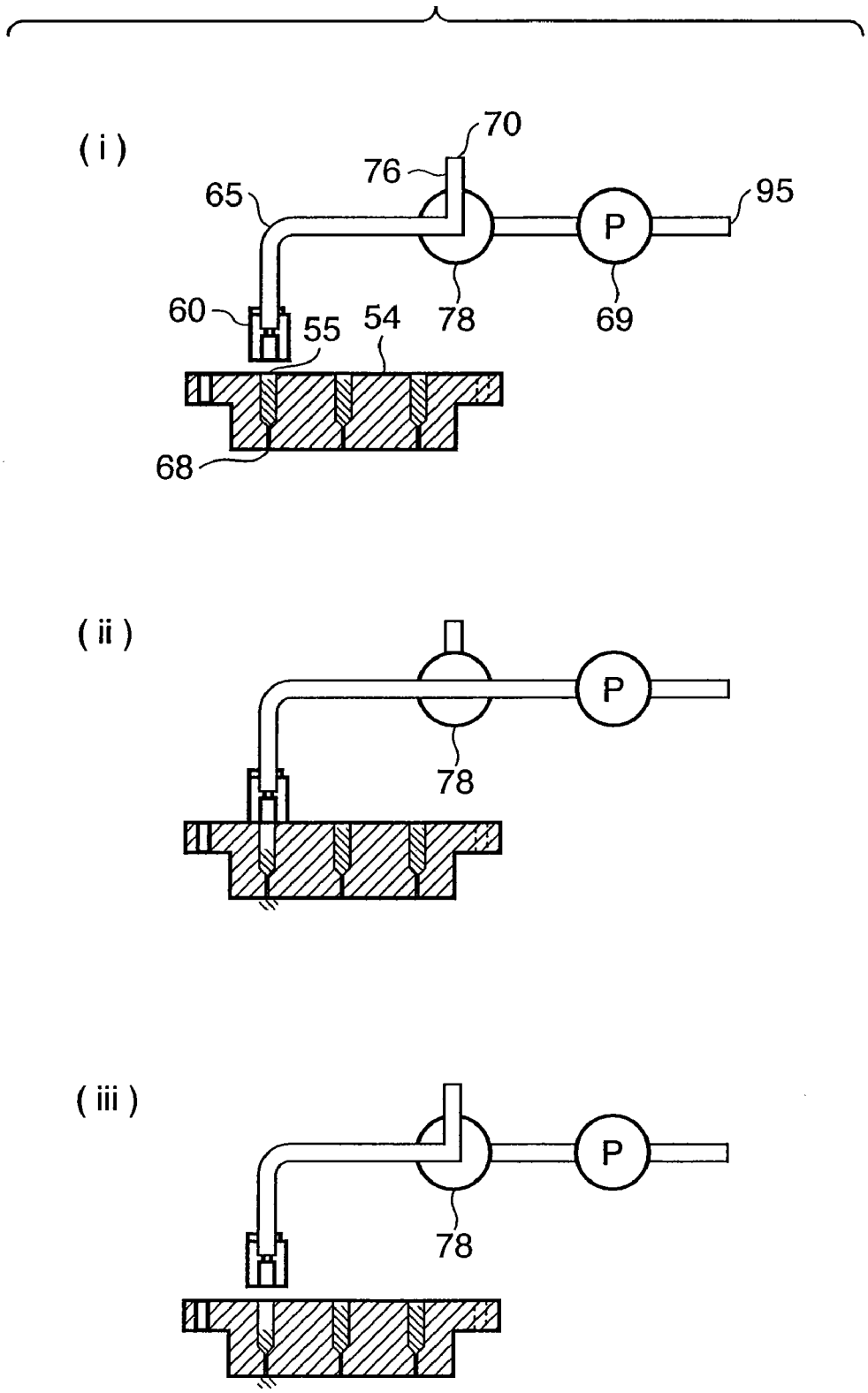
FIG. 12 is a detailed view showing states of the recovery unit portion according to the third embodiment of the present invention.

FIG. 12 shows flow channel diagrams (i), (ii), and (iii) of gas injection into the liquid supply ports 55 formed in the head 54. In FIG. 12, (i) represents a state in the wait mode, (ii) represents a state in the injection mode, and (iii) represents a state in the cap release mode.

In the wait mode ((i)), different liquids have been injected into the liquid supply ports 55.

The caps 60 are separate from the head 54. Each cap 60 can approach a corresponding liquid supply port 55 without coming into contact with any other liquid supply port 55. The tubes 65 communicating with the caps 60 are connected to the atmosphere valves 78. In the wait mode, the tubes 65 communicate with the atmosphere tubes 76 through the atmosphere valves 78. The atmosphere ports 70 of the atmosphere tubes 76 are open to the atmosphere.

In the injection mode ((ii)), the caps 60 are in tight contact with the head 54. The atmosphere valves 78 are electromagnetic valves, and their connecting portions to communicate can be switched by an electrical signal. After the caps 60 come into tight contact with the head 54, the atmosphere valves 78 operate to connect the tubes 65 and pumps 69 to each other. After that, the pumps 69 are operated, so that the gas is injected into the liquid supply ports 55 through the caps 60. As a result, the medium in the nozzles 68 such as small dust, bubbles, and liquids with increased viscosities is pushed out from the nozzles 68.

In the cap release mode ((iii)), after the operation of the pumps 69 is completed, the atmosphere valves 78 are operated so that the tubes 65 and atmosphere tubes 76 communicate with each other. After that, the caps 60 are moved upward, thereby separating them from the head 54.

After the operations of (i), (ii), and (iii) are completed, the X stage moving portion 66 is operated to move the caps 60, and the same operations of (i), (ii), and (iii) are performed. Thus, the gas can be injected into all the liquid supply ports 55. Even when the number of liquid supply ports 55 increases, if this arrangement is built more in accordance with the number of liquid supply ports, the same operation can be performed.

Also, the gas can be injected into only some of the plurality of liquid supply ports 55. Regarding a method for this, when the cap 60 is in contact with that liquid supply port 55 into which the gas is not to be injected, the corresponding atmosphere valve 78 and pump 69 are not operated in the above operations of (ii) and (iii). When the caps 60 are in contact with those liquid supply ports 55 into which the gas is to be injected, the above operations of (i), (ii), and (iii) are performed. Then, the gas can be injected into only some liquid supply ports 55.

Alternatively, caps 60 equal in number to that of the liquid supply ports 55 may be provided at positions corresponding to the liquid supply ports 55, and atmosphere valves 78, pumps 69, and the like may be provided to correspond to the caps 60. Then, no X stage moving portion 66 need be provided, and the gas can be injected into all or some of the liquid supply ports 55.

In the same manner as in the first embodiment, in the discharging apparatus having the recovery unit portion, after a medium such as small dust, bubbles, and liquids with increased viscosities is removed by the recovery unit portion, liquids are injected into the respective nozzles. The Y-axis stage 73 and X-axis stage 74 (see FIG. 8) are operated, and the head 54 discharges the liquids, so that the liquids are discharged to predetermined positions of the to-be-printed member 84.

As is apparent from the above description, in the discharging apparatus according to this embodiment, the recovery unit portion which forms the discharging apparatus has the caps that operate to cover the supply ports of predetermined nozzles, when the medium in the nozzles is to be removed, so as to come into tight contact with the head. Even if a nozzle adjacent to a nozzle 68 from which the medium is to be pushed out has not been injected with any liquid, the liquid or the like in the nozzle 68 from which the medium is to be pushed out can be removed reliably without being adversely affected by this adjacent nozzle.

Fourth Embodiment

In the first and second embodiments, the recovery unit portion itself is formed integrally. However, the present invention is not limited to this. The recovery unit portion may be separated into, e.g., a portion (joint member) that comes into contact with the head and a portion (suction unit portion) that performs suction. A recovery unit portion which forms a discharging apparatus according to this embodiment will be described with reference to FIGS. 13 to 22. The suction unit portion which forms the recovery unit portion may be formed integrally with a portion that forms a discharging function such as nozzles, or may be formed as a separate unit.

<Arrangement of Suction Unit Portion>

Figure 13:
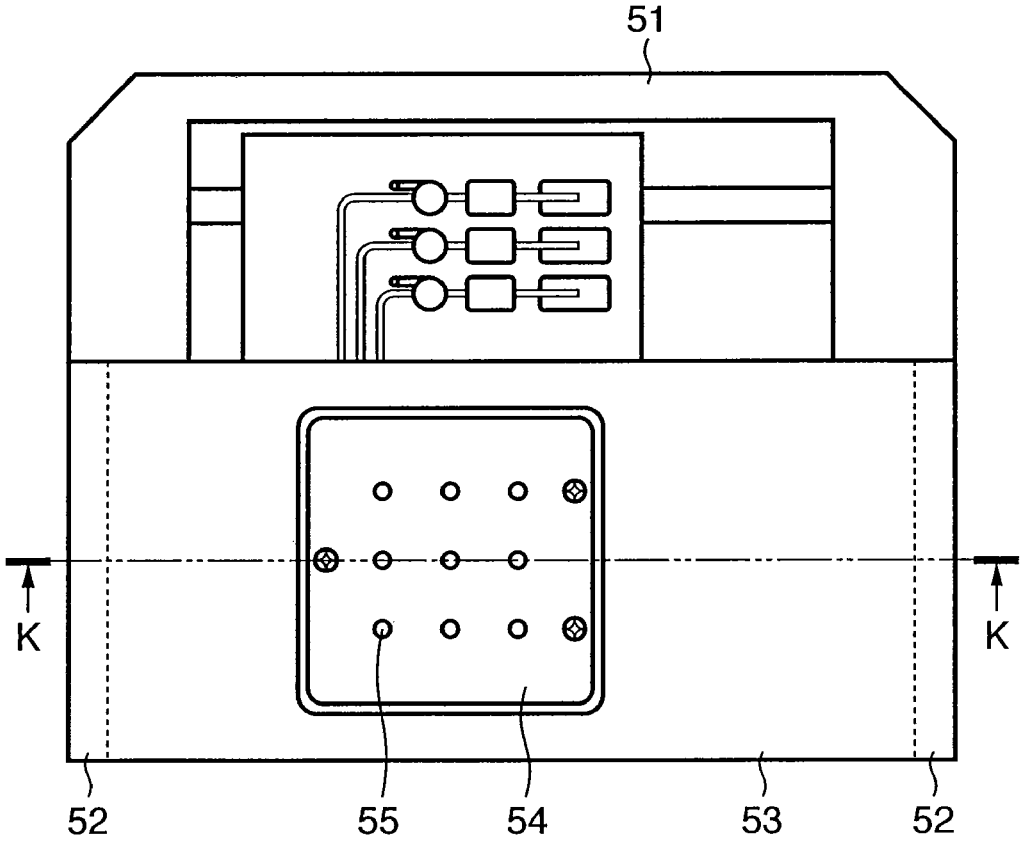
FIG. 13 is a plan view of a suction unit portion according the third embodiment of the present invention.

FIG. 13 is a plan view of the suction unit portion which forms the recovery unit portion according to this embodiment. In this embodiment, the suction unit portion is formed as a unit separate from a portion that forms a discharging function such as nozzles. Side plates 52 are arranged on a base plate 51, and a head plate 53 is attached on the side plates 52. A head 54 is attached to the head plate 53 with machine screws. The head 54 has nine liquid supply ports 55. The respective liquid supply ports 55 communicate with different nozzles. Different liquids are injected into the respective liquid supply ports 55. Hence, the respective nozzles discharge different liquids.

Figure 14:
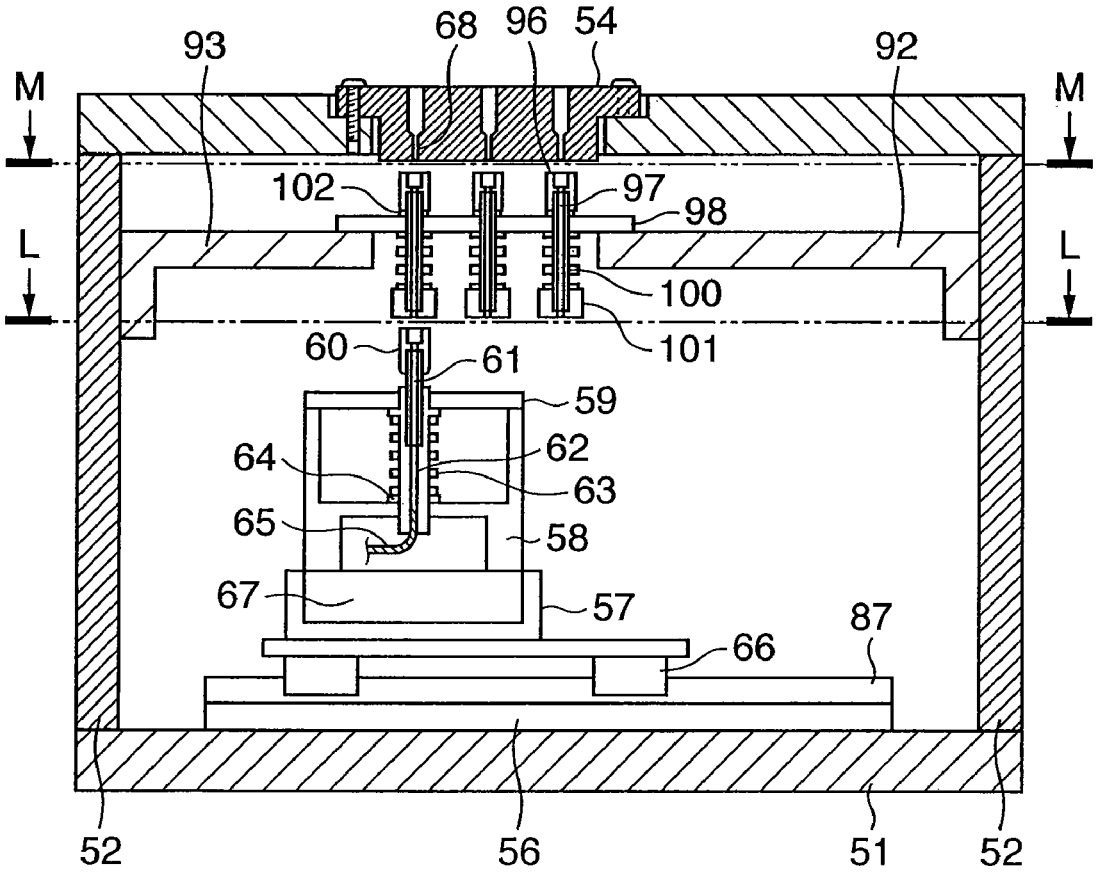
FIG. 14 is a sectional view taken along the line K-K of FIG. 13.

FIG. 14 is a sectional view taken along the line K-K of FIG. 13. The head 54 has nozzles 68. An X stage 56 is mounted on the base plate 51. The X stage 56 has rails 87. An X stage moving portion 66 moves on the rails 87 to the left or right. A Z stage 57 is attached on the X stage moving portion 66. A Z stage moving portion 67 movably arranged on the Z stage 57 moves vertically with respect to the Z stage 57. A cap base 58 is attached to the Z stage moving portion 67. A cap plate 59 is attached to the cap base 58. Caps 60 are arranged at positions opposing the nozzles 68. The caps 60 are formed of rubber members, and are pressed into cap pipes 61.

The cap pipes 61 are adhered to cap joints 62. The cap joints 62 can move with respect to the cap base 58. The cap joints 62 are positioned as they are inserted in holes formed in the cap plate 59. Cap springs 63 are mounted on the outer surfaces of the cap joints 62, respectively. Cap washers 64 are interposed between the cap springs 63 and cap base 58. Tubes 65 are adhered to the cap joints 62.

<Arrangement of Joint Member>

Joint members are arranged above the caps 60, and adapter joints 101 are disposed to oppose the caps 60.

Each adapter joint 101 has a hole at its center and is adhered to a corresponding adapter pipe 97. The adapter pipes 97 are slidably inserted in corresponding holes formed in an adapter plate 98. Adapter caps 96 are pressed into the adapter pipes 97, respectively. The adapter pipes 97 and adapter caps 96 are hollow. Thus, the holes in the adapter joints 101 and the hollow portions of the adapter caps 96 communicate with each other. The adapter caps 96 are formed of rubber members. Adapter springs 100 are mounted on the outer surfaces of the adapter pipes 97. The adapter pipes 97 have dropping preventive portions 102, respectively. The adapter caps 96, adapter pipes 97, and adapter joints 101 are pushed downward in FIG. 14 with respect to the adapter plate 98 by the adapter springs 100. The dropping preventive portions 102 integrally formed on the adapter pipes 97 abut against the adapter plate 98, so the adapter pipes 97 will not drop from the adapter plate 98. The adapter plate 98 is supported by adapter plate supports 92 and 93. The adapter plate supports 92 and 93 are fixed to the side plates 52, respectively.

Figure 15:
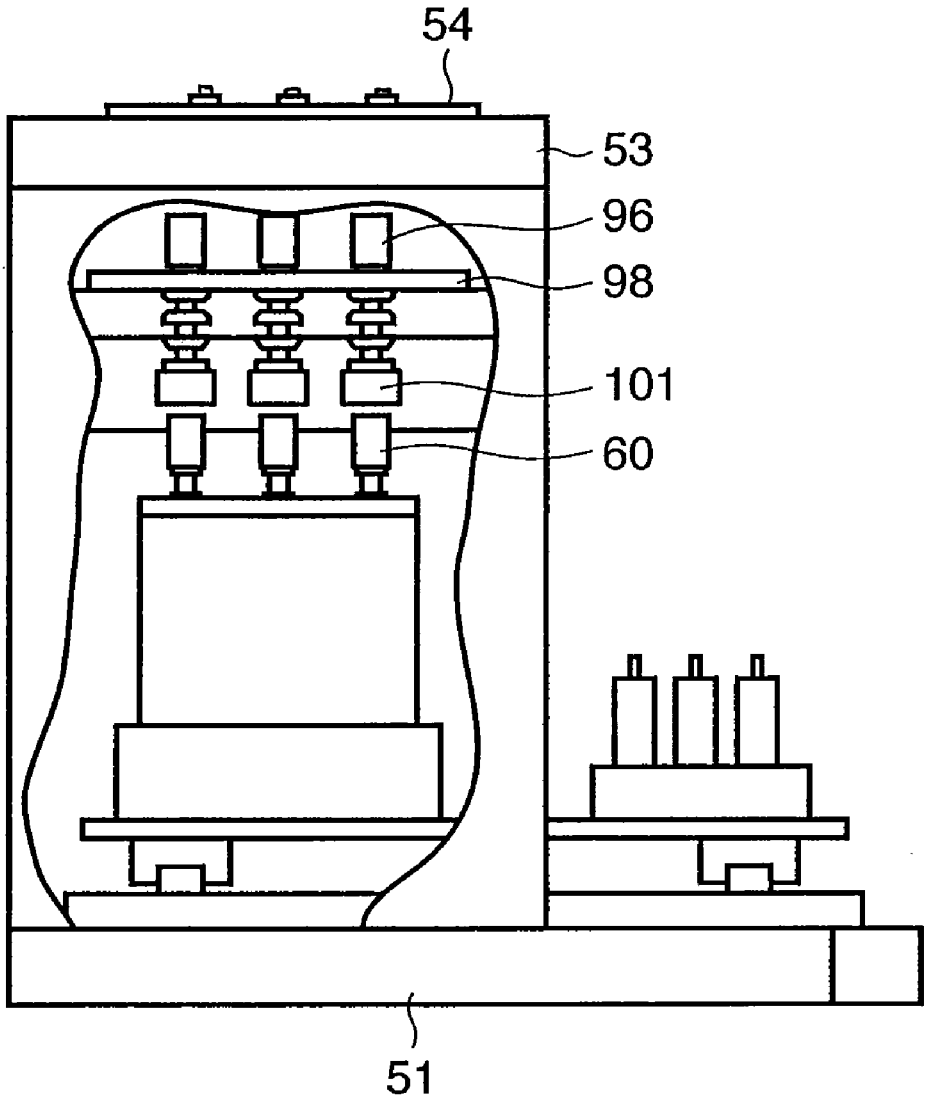
FIG. 15 is a right sectional view of a suction unit portion according to the fourth embodiment of the present invention.

FIG. 15 is a right side view of FIG. 13. As shown in FIG. 15, the caps 60 include three caps 60. The adapter joints 101 and adapter caps 96 are provided at positions corresponding to the caps 60.

<Other Arrangement of Recovery Unit Portion>

Figure 16:
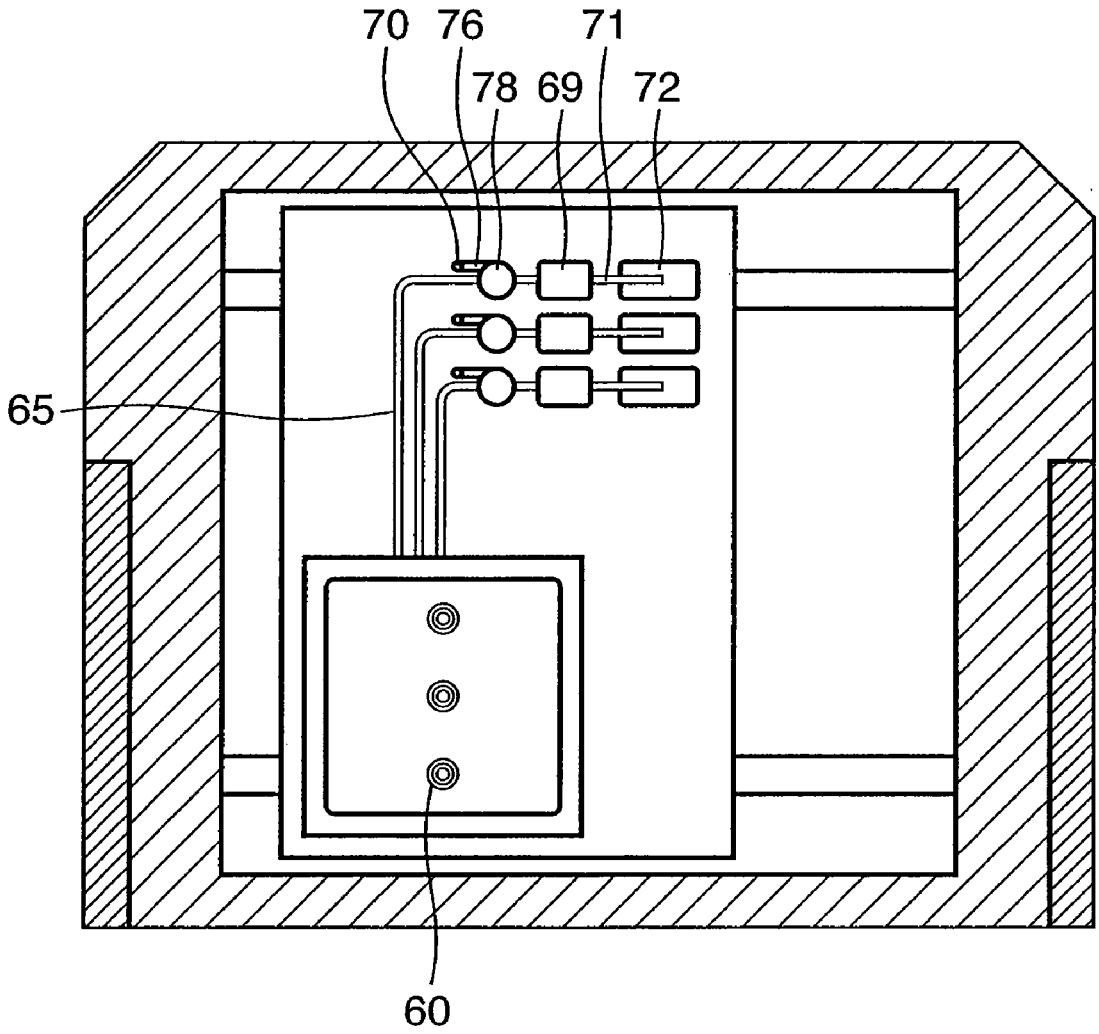
FIG. 16 is a sectional view taken along the line L-L of FIG. 14.

FIG. 16 is a sectional view taken along the line L-L of FIG. 14. The tubes 65 communicate with the caps 60 and are connected to atmosphere valves 78, respectively. The atmosphere valves 78 are three-way valves.

One connecting portion of each atmosphere valve 78 is connected to an atmosphere tube 76. The distal end of the atmosphere tube 76 forms an atmosphere port 70, and is open to the atmosphere. Another connecting portion of the atmosphere valve 78 is connected to a pump 69 through a tube. A waste liquid tube 71 is connected to the pump 69. The other end of the waste liquid tube 71 is connected to a waste liquid tank 72. One atmosphere valve 78, one pump 69, and one waste liquid tank 72 are provided to each cap 60.

<Operations of Joint Member and Suction Unit Portion>

Figure 17:
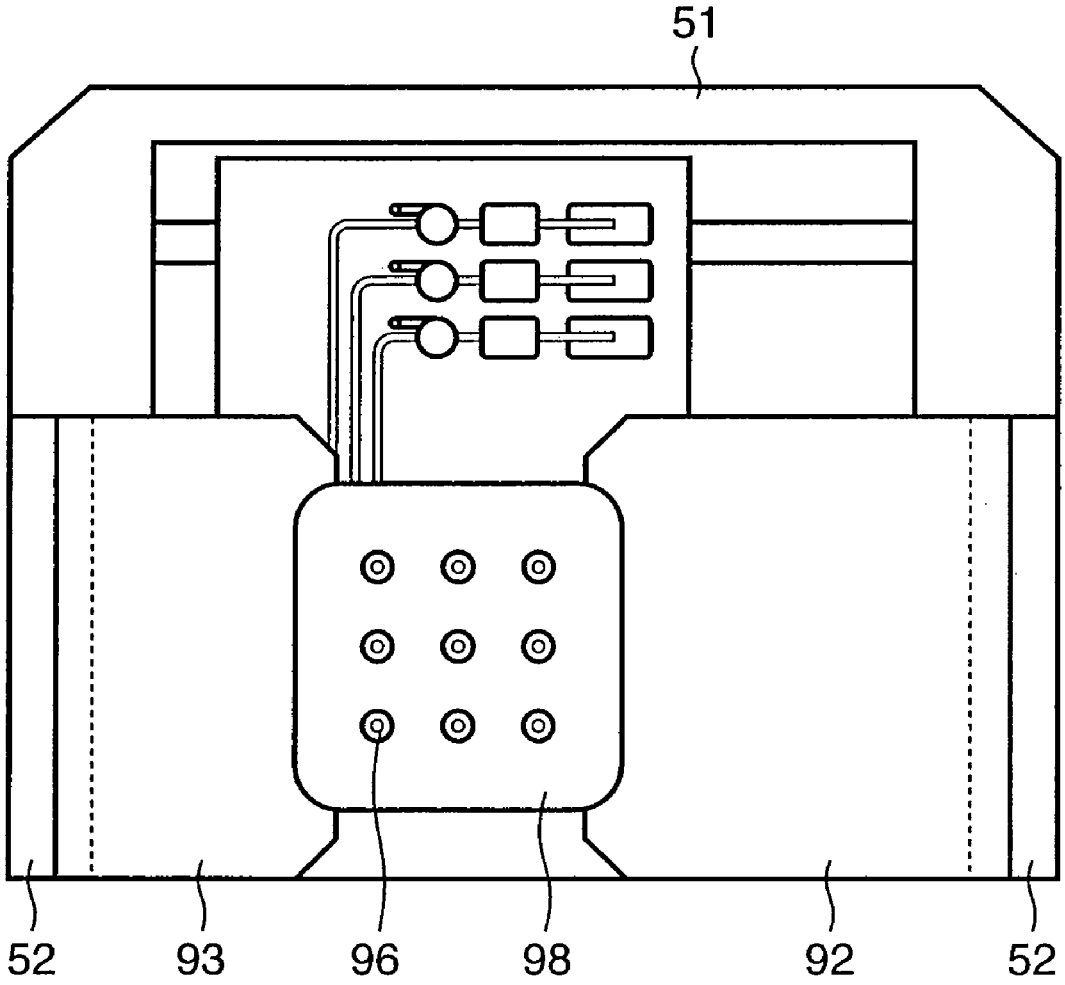
FIG. 17 is a sectional view taken along the line M-M of FIG. 14.

FIG. 17 is a sectional view taken along the line M-M of FIG. 14. The adapter caps 96 are provided in one to one correspondence to positions corresponding to all the nozzles 68 formed in the head 54. As the number of nozzles 68 is nine, the number of adapter caps 96 is also nine.

Figure 18:
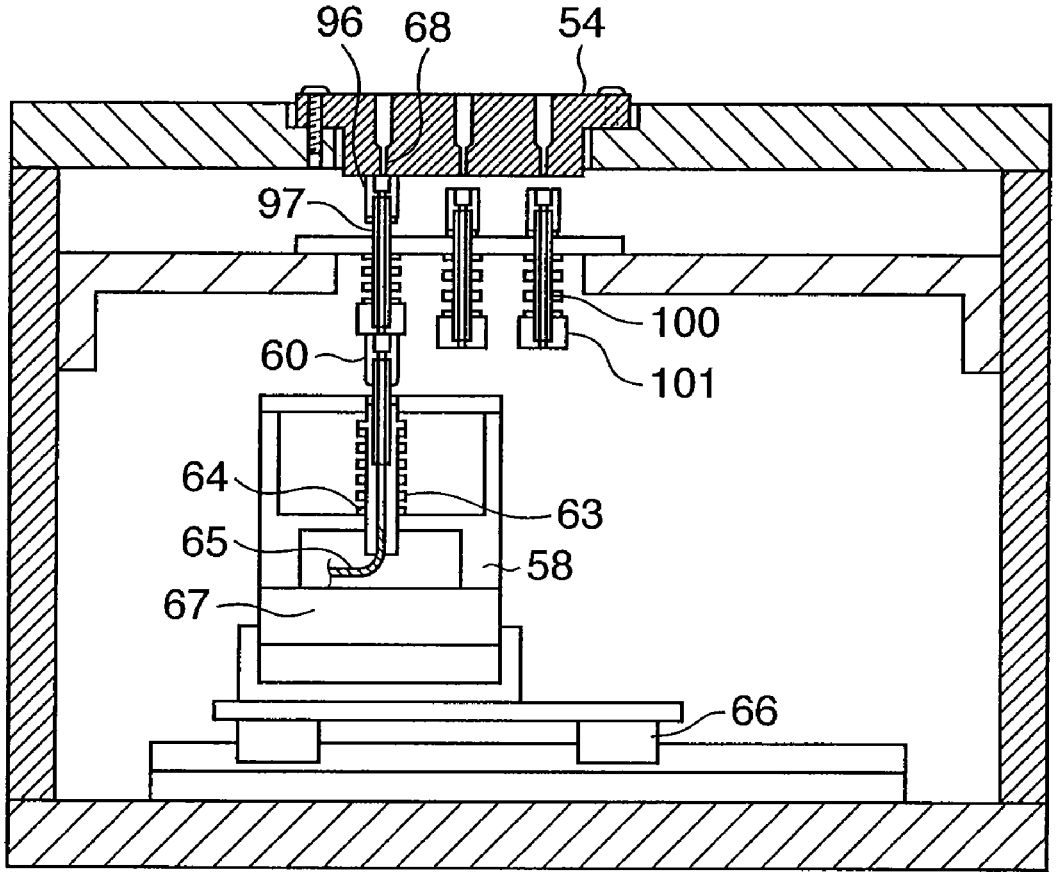
FIG. 18 is a sectional view taken along the line K-K of FIG. 13 when a Z stage moving portion moves upward.

FIG. 18 is a sectional view taken along the line K-K of FIG. 13 in a state wherein the Z stage moving portion 67 has moved upward. When the Z stage moving portion 67 is moved upward, the caps 60 come into contact with the adapter joints 101. When the Z stage moving portion 67 is further moved upward, the cap base 58 and cap washers 64 move upward. As a result, the cap springs 63 and adapter springs 100 are compressed and the caps 60 and adapter caps 96 deflect, so that the adapter caps 96 and head 54 come into tight contact with each other. The caps 60 and adapter joints 101 also come into tight contact with each other. Then, pumps communicating with the tubes 65 are actuated. Liquids are thus drawn by suction from the nozzles 68 through the adapter caps 96, adapter pipes 97, adapter joints 101, and caps 60. When the liquids are drawn by suction from the nozzles 68, the medium in the nozzles 68 such as small dust, bubbles, and liquids with high viscosities is removed.

Subsequently, when the Z stage moving portion 67 is moved downward, the adapter caps 96 separate from the head 54. When the X stage moving portion 66 is moved to the right in FIG. 18, the suction operation described above can be performed from the two other nozzles 68.

When the adapter pipes 97 are formed of flexible members so that they can come into tight contact with the head 54, the adapter caps 96 need not be used. In this case, that portion of each adapter pipe 97 which can come into tight contact with the head 54 can approach a corresponding nozzle 68 without coming into contact with any other nozzle 68. The suction port of each adapter pipe 97 is larger than the opening of each nozzle 68.

<Arrangement of Head>

Figure 19:
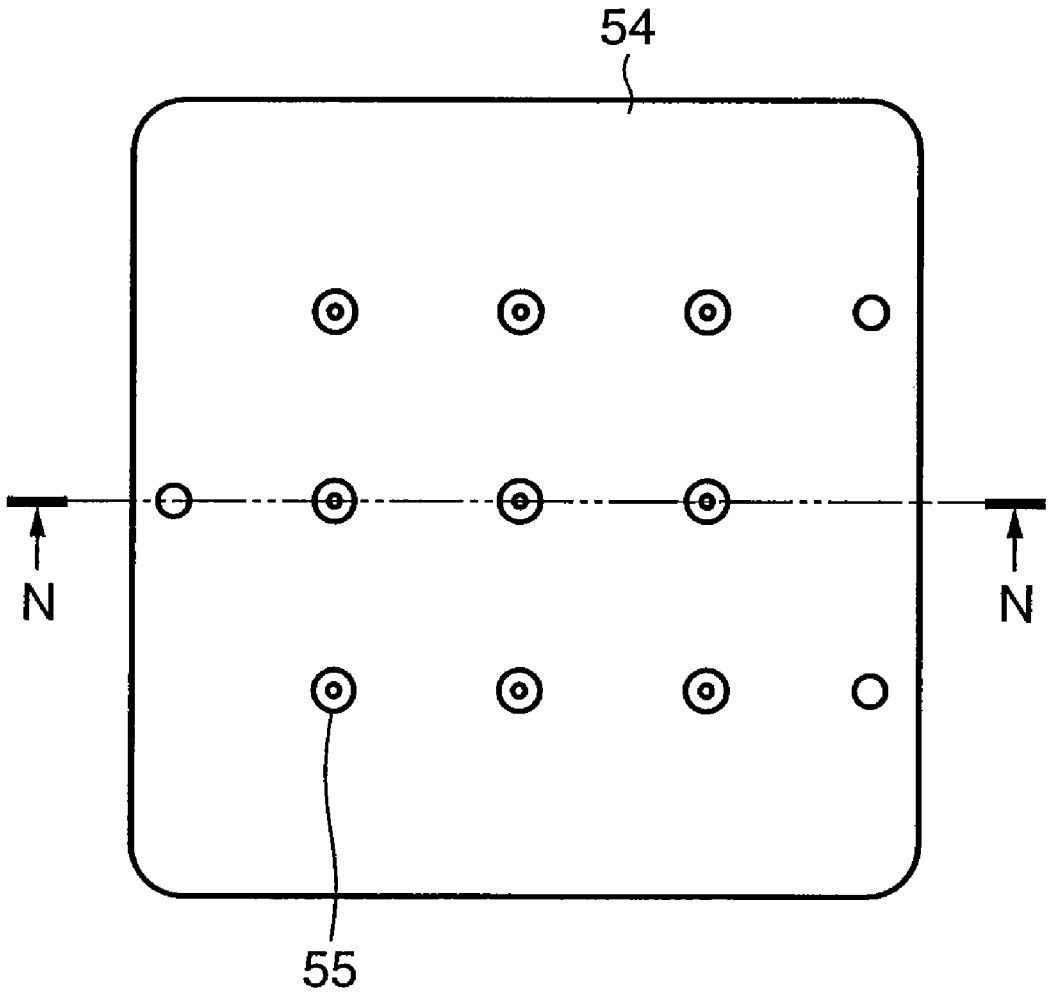
FIG. 19 is a plan view of a head.
Figure 20:
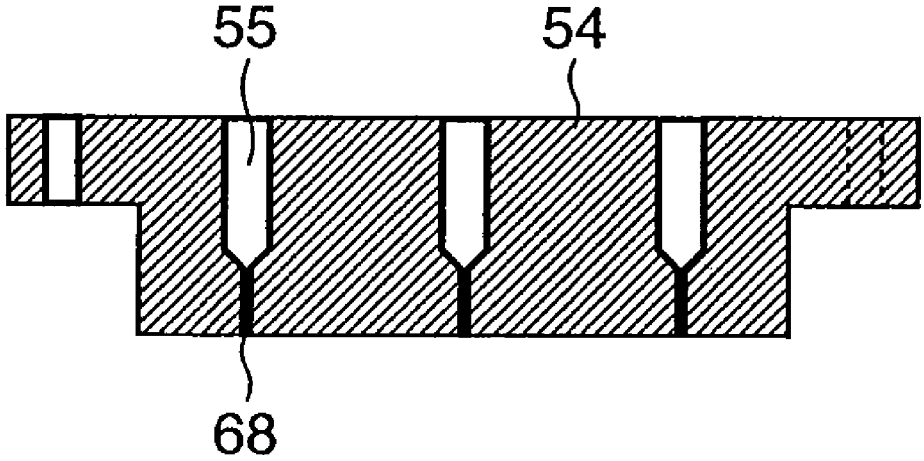
FIG. 20 is a sectional view taken along the line N-N of FIG. 19.

FIG. 19 is a plan view of the head 54 alone. As described above, the head 54 has the nine liquid supply ports 55. FIG. 20 is a sectional view taken along the line N-N of FIG. 19. As described above, the head 54 has the nozzles 68, and the respective liquid supply ports 55 communicate with the different nozzles 68.

<Operation of Recovery Unit Portion>

Figure 21:
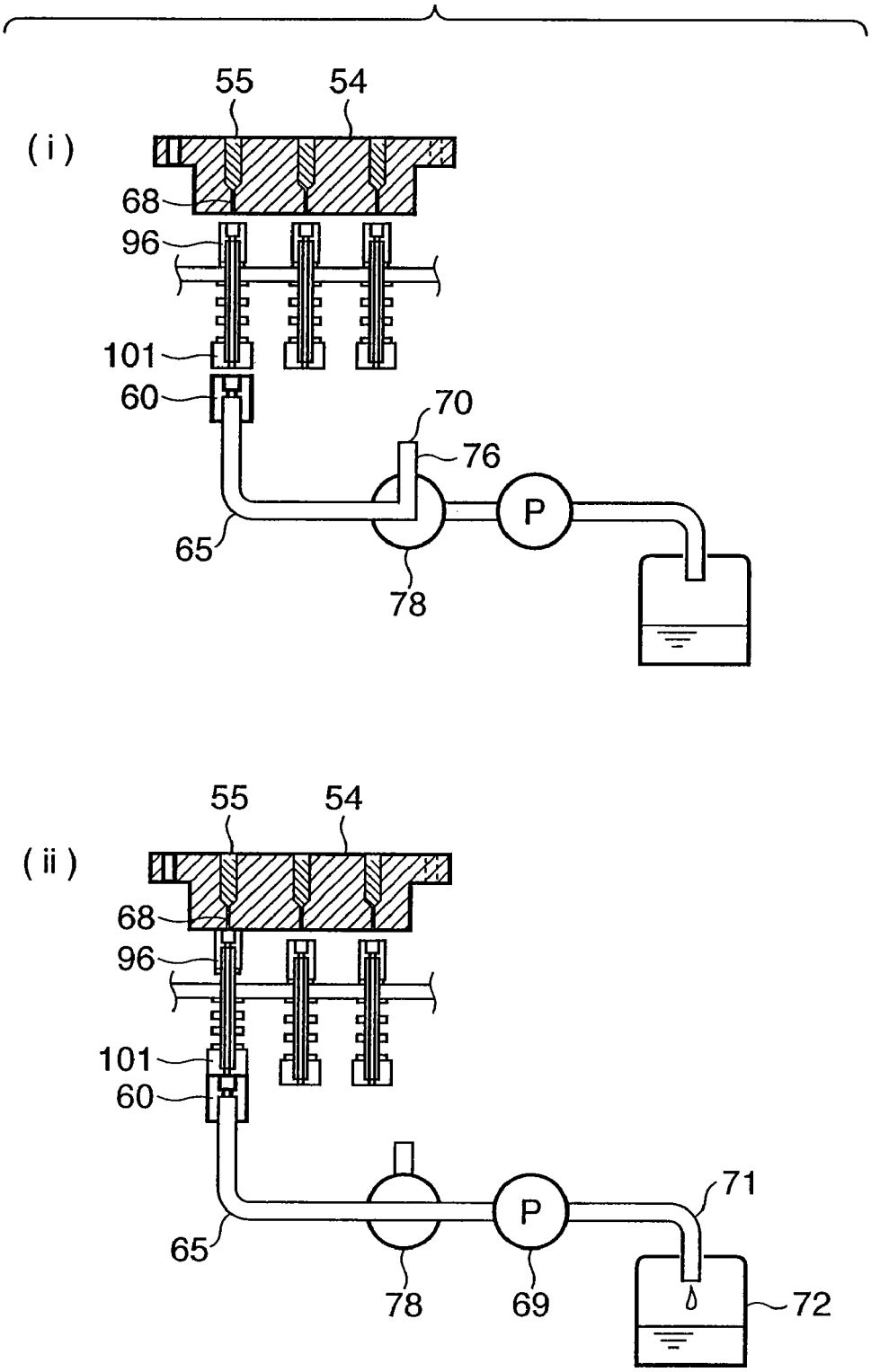
FIG. 21 is a view showing states (wait mode and suction mode) of the suction unit portion according to the fourth embodiment of the present invention.
Figure 22:
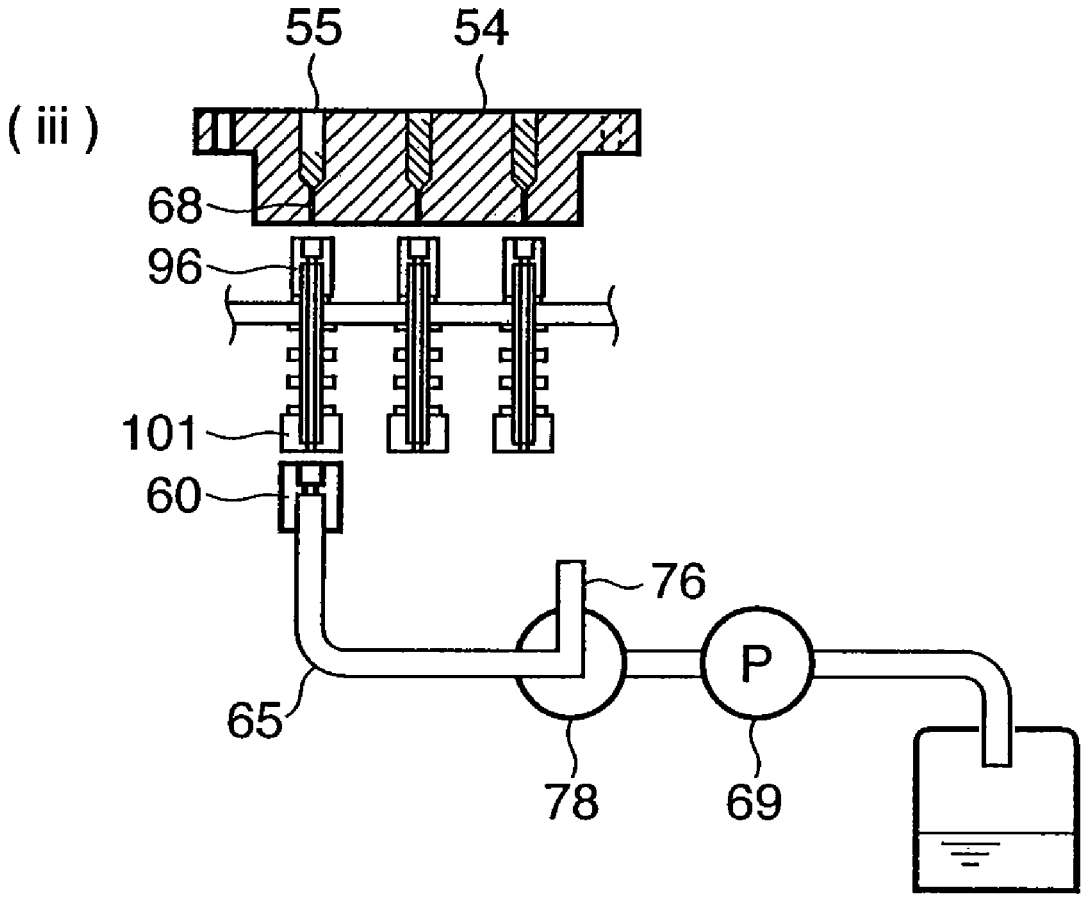
FIG. 22 is a view showing a state (cap release mode) of the suction unit portion according to the fourth embodiment of the present invention.

FIGS. 21 and 22 show flow channel diagrams (i), (ii), and (iii) of liquid suction from the nozzles 68 formed in the head 54. In FIGS. 21 and 22, (i) represents a state in the wait mode, (ii) represents a state in the suction mode, and (iii) represents a state in the cap release mode.

In the wait mode ((i)), different liquids have been injected into the liquid supply ports 55.

The adapter caps 96 are separate from the head 54. Each adapter cap 96 can approach a corresponding nozzle 68 without coming into contact with any other nozzle 68. The suction port of each adapter cap 96 is larger than the opening of each nozzle 68. Each cap 60 can approach a corresponding adapter joint 101 without coming into contact with any other adapter joint 101. The tubes 65 communicating with the caps 60 are connected to the atmosphere valves 78. In the wait mode, the tubes 65 communicate with the atmosphere tubes 76 through the atmosphere valves 78. The atmosphere ports 70 of the atmosphere tubes 76 are open to the atmosphere.

In the suction mode ((ii)), the adapter caps 96 are in tight contact with the head 54. The caps 60 are in tight contact with the adapter joints 101. The atmosphere valves 78 are electromagnetic valves, and their connecting portions to communicate can be switched by an electrical signal. After the adapter caps 96 come into tight contact with the head 54 and the caps 60 come into tight contact with the adapter joints 101, the atmosphere valves 78 operate to connect the tubes 65 and pumps 69 to each other. After that, the pumps 69 are operated, so that the liquids are drawn by suction from the nozzles 68 through the adapter caps 96. As a result, the liquids drawn by suction are discharged from the waste liquid tubes 71 to the waste liquid tanks 72.

In the cap release mode ((iii)), after the operation of the pumps 69 is completed, the atmosphere valves 78 are operated so that the tubes 65 and atmosphere tubes 76 communicate with each other. After that, the caps 60 are moved downward, thereby separating them from the adapter joints 101, and the adapter caps 96 from the head 54.

After the operations of (i), (ii), and (iii) are completed, the X stage moving portion 66 is operated to move the caps 60, and the same operations of (i), (ii), and (iii) are performed. Thus, the liquids can be drawn by suction from all the nozzles 68. Even when the number of nozzles 68 increases, if this arrangement is built more in accordance with the number of nozzles, the same operation can be performed.

Also, the liquid can be drawn by suction from only some of the plurality of nozzles 68. Regarding a method for this, when the adapter cap 96 is in tight contact with that nozzle 68 from which the liquid is not to be drawn by suction, the corresponding atmosphere valve 78 and pump 69 are not operated in the above operations of (ii) and (iii). When the adapter caps 96 are in tight contact with those nozzles 68 from which the liquids are to be drawn by suction, the above operations of (i), (ii), and (iii) are performed. Then, the liquids can be drawn by suction from only some nozzles 68.

<Arrangement of Discharging Apparatus>

Figure 23:
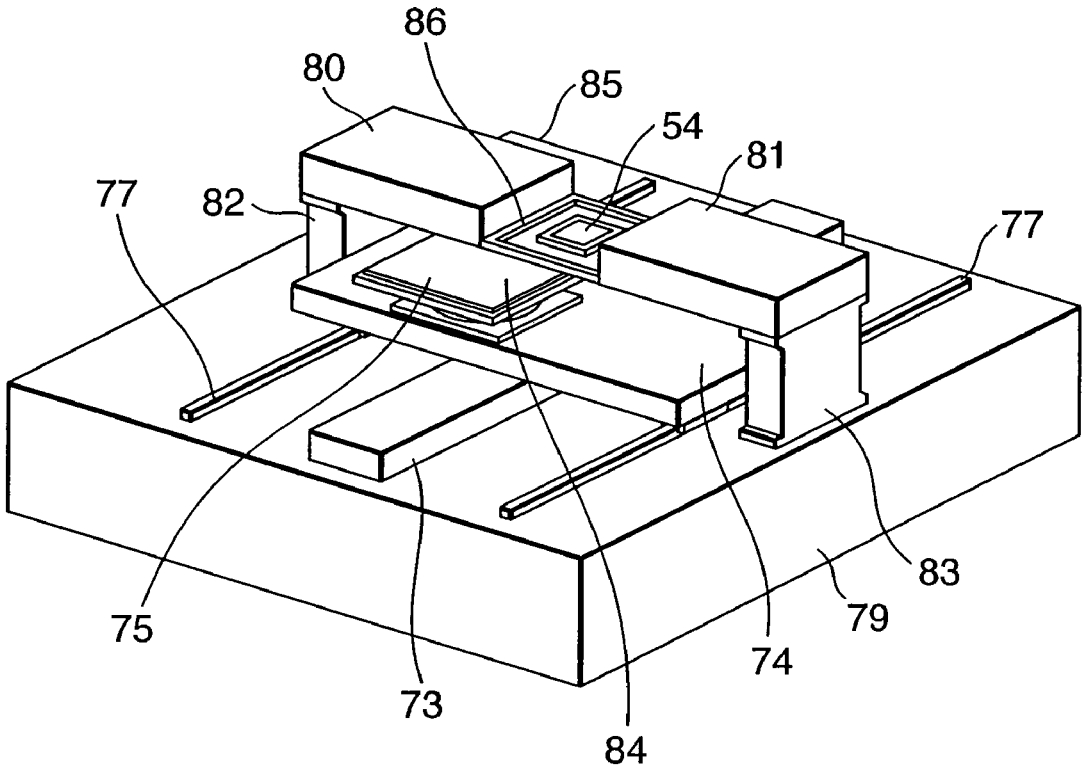
FIG. 23 is a perspective view of a discharging apparatus according to the fourth embodiment of the present invention.
Figure 24:
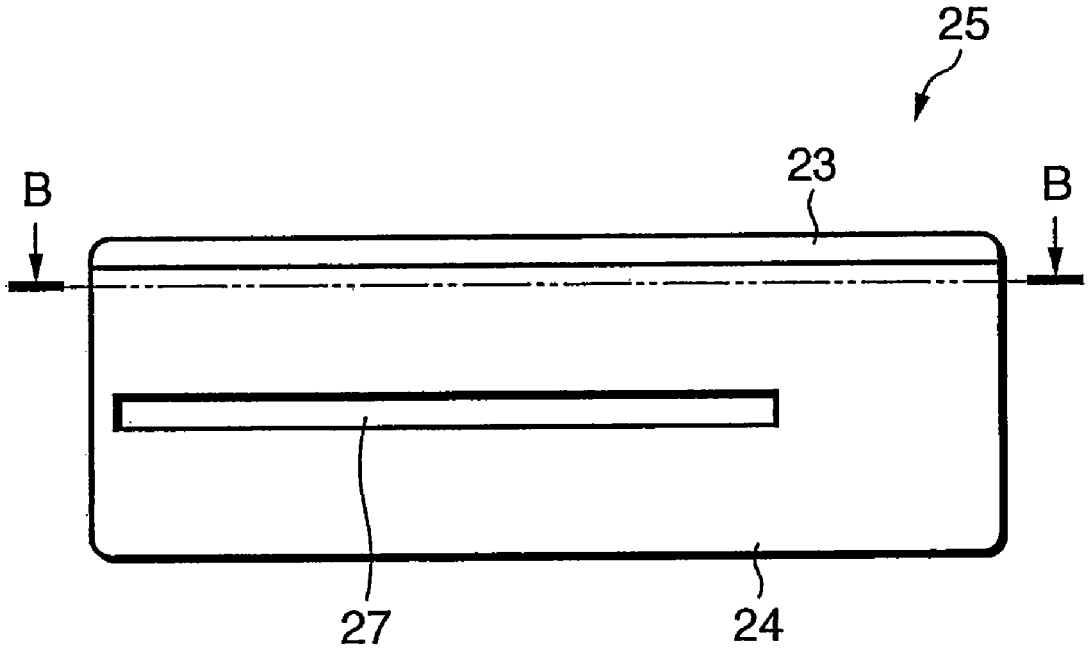
FIG. 24 is a front view of a conventional inkjet printer.
Figure 25:
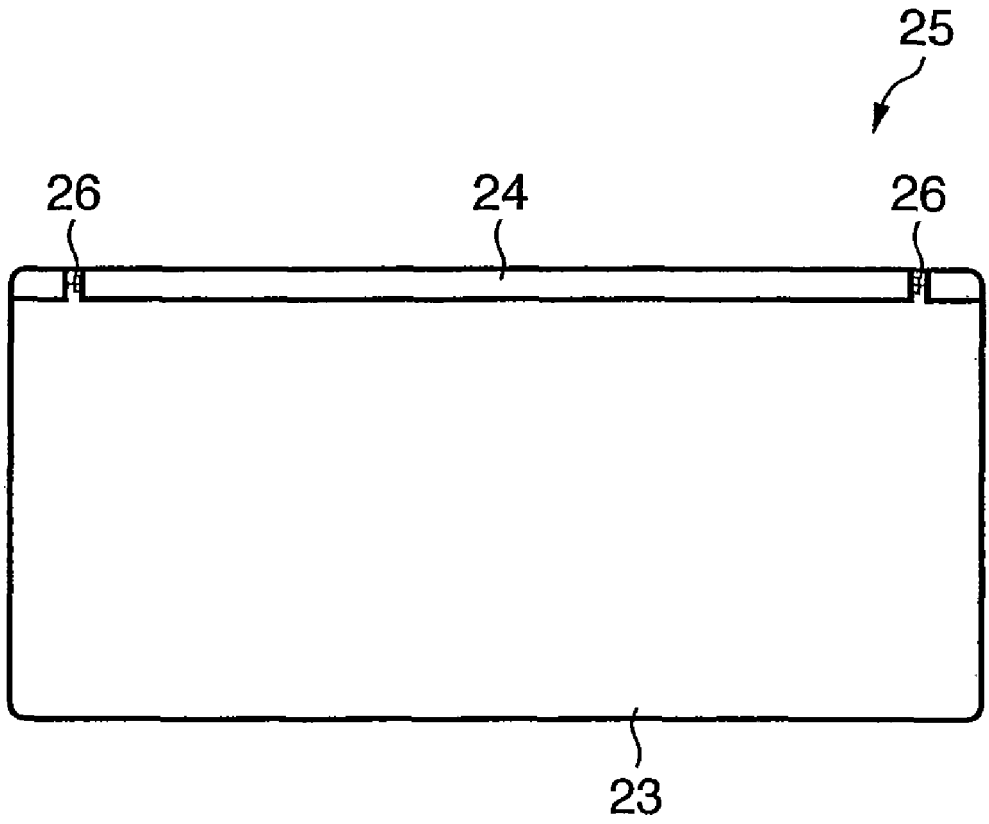
FIG. 25 is a plan view of the same.
Figure 26:
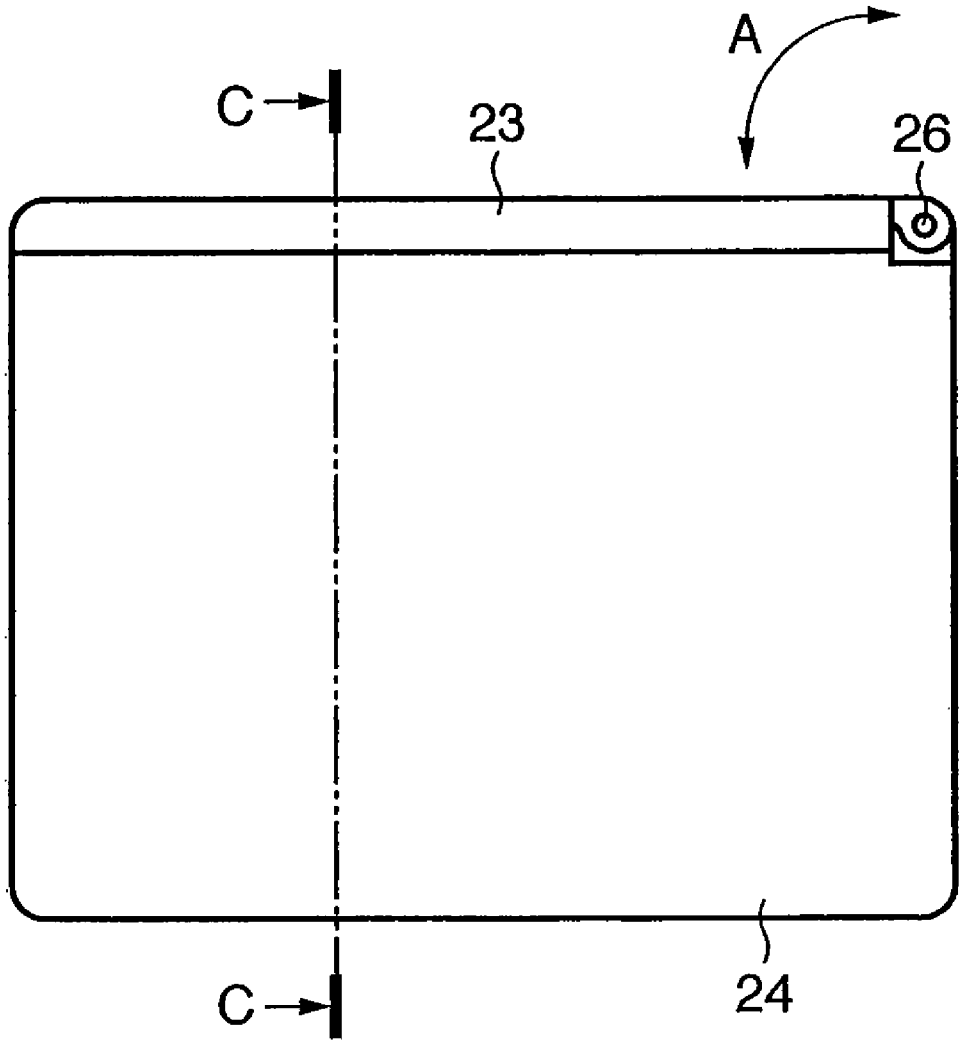
FIG. 26 is a side view of the same.
Figure 27:
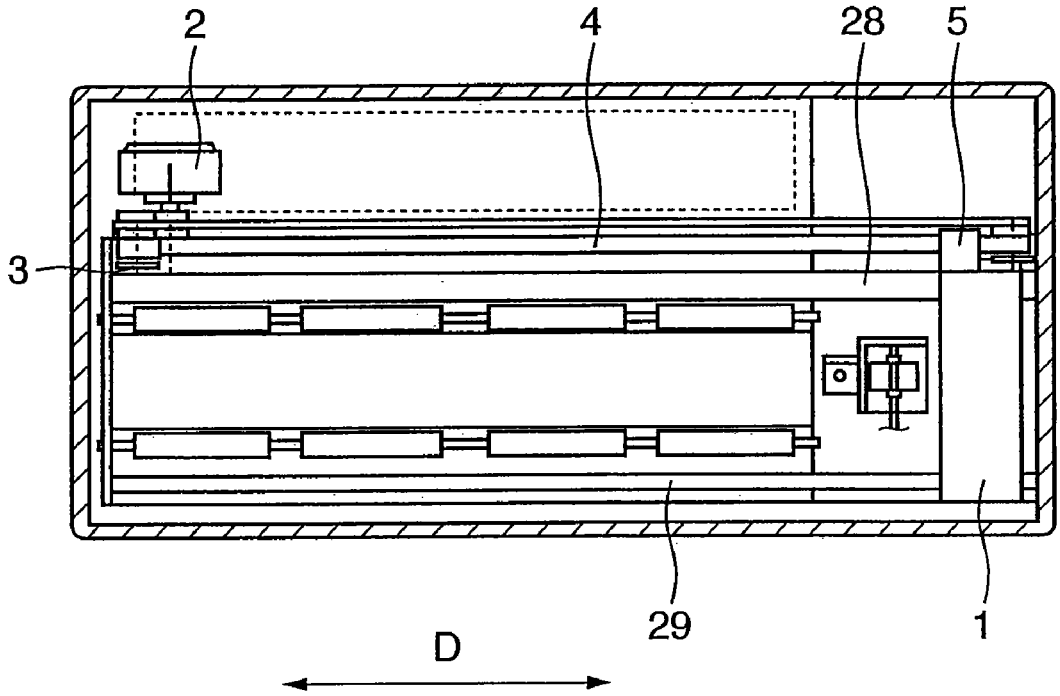
FIG. 27 is a sectional view taken along the line B-B of FIG. 24.
Figure 28:
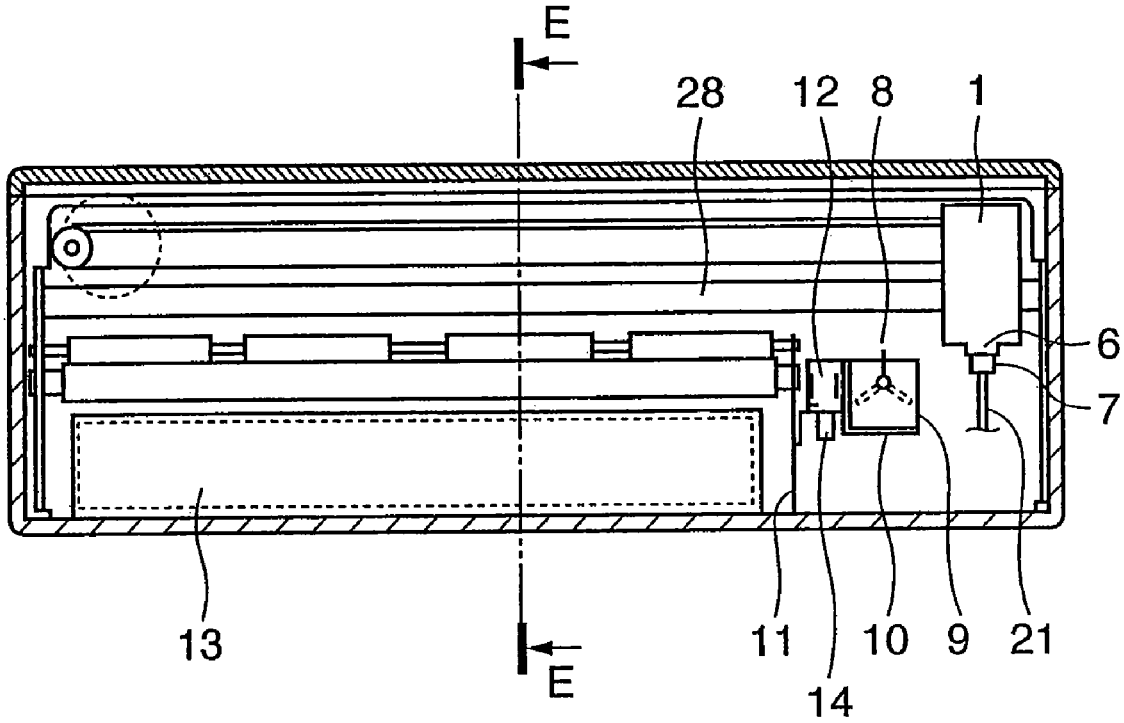
FIG. 28 is a sectional view taken along the line C-C of FIG. 26.
Figure 29:
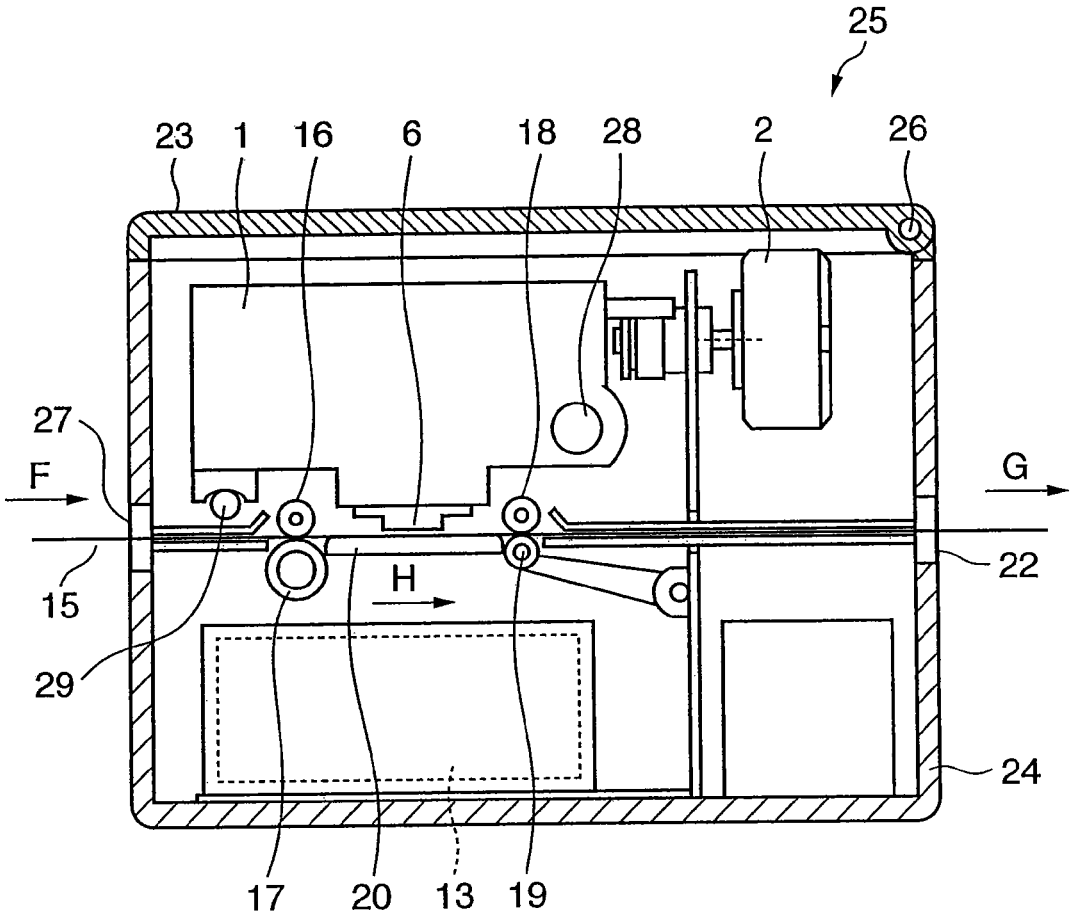
FIG. 29 is a sectional view taken along the line E-E of FIG. 28.

The discharging apparatus according to this embodiment will be described. FIG. 23 is a perspective view of the discharging apparatus. A Y-axis stage 73 and guide rails 77 are fixed on a surface plate 79 parallel to each other. An X-axis stage 74 is attached to the moving portions of the Y-axis stage 73 and guide rails 77, so the X-axis stage 74 can move in the Y-axis direction. A chuck 75 is fixed to the moving portion of the X-axis stage 74. The chuck 75 is connected to a pump (not shown) through a tube. When the pump takes in air by suction, a to-be-printed member 84 is chucked by the chuck 75. Support columns 82 and 83 are fixed on the surface plate 79, and bridges 80 and 81 are fixed to the support columns 82 and 83, respectively. The bridges 80 and 81 are fixed to each other through a stay 85. Thus, the strength of the structure consisting of the support columns 82 and 83 and bridges 80 and 81 can be held. A head mounting table 86 is fixed between the bridges 80 and 81. The head 54 is fixed to the head mounting table 86.

In the recovery unit portion (not shown) which forms the discharging apparatus described above, a medium such as small dust, bubbles, and liquids with increased viscosities is removed. After that, in the discharging apparatus, liquids are injected into the respective nozzles. The Y-axis stage 73 and X-axis stage 74 are operated, and the head 54 discharges the liquids, so that the liquids are discharged to predetermined positions of the to-be-printed member 84.

As is apparent from the above description, according to this embodiment, even when suction is performed by suction unit portions in number smaller than that of the nozzles that require suction, as the joint members which come into contact with the head are provided separately, the liquids in the respective nozzles can be prevented from being mixed.

When a large number of nozzles are formed in the head, the number of adapter caps that come into contact with the head simultaneously can be decreased to be smaller than the number of nozzles. Then, no excessive force need be applied to the head, so that deflection of the head can be prevented.

The present invention is not limited to the above embodiments and various changes and modifications can be made within the spirit and scope of the present invention. Therefore to apprise the public of the scope of the present invention, the following claims are made.

What is claimed is:

1. An apparatus having a suction unit which can suction liquid in a discharge nozzle of a discharge head in which a plurality of discharge nozzles are arranged to discharge liquids supplied from supply ports, comprising:

joint members equal in number to a number of the discharge nozzles and being arranged to face the discharge nozzles, wherein each joint member operates to cover a corresponding one of the discharge nozzles when suctioning one of the discharge nozzles; and a connecting member selectively connectable to each of said joint members, said connecting member being fluidly connected to the suction member, wherein each of said joint members operates to cover a corresponding one of the discharge nozzles in a state of being selectively connected by said connecting member, and does not operate to cover a corresponding one of the discharge nozzles in a state of not being selectively connected by said connecting member, and wherein the suction unit suctions liquid in the discharge nozzle which is covered by said joint member selectively connected by said connecting member.

2. The apparatus according to claim 1, wherein the discharge head comprises electrothermal transducers which generate heat energy for liquid discharge.

3. The apparatus according to claim 1, wherein the suction unit suctions liquid in each of the discharge nozzles by applying a pressure difference between a supply port and a discharge port of each discharge nozzle which is covered by said joint member selectively connected by said connecting member.

4. The apparatus according to claim 1, further comprising a head mounting table for fixing the discharge head, and a stage for holding a to-be-printed member.

5. A method executed by an apparatus having a discharge head in which a plurality of discharge nozzles are arranged to discharge liquids supplied from supply ports and a suction unit which can suction liquid in the discharge nozzles, the method comprising the steps of:

operating each of joint members individually, a number of the joint members being equal to a number of the discharge nozzles and being arranged to face the discharge nozzles so that each of the joint members covers a corresponding discharge nozzle during suctioning of the discharge nozzles;

selectively connecting a connecting member with any one of the joint members, the connecting member being fluidly connected to the suction unit; and controlling the suction unit connected with the connecting member so that the suction unit suctions liquid in the discharge nozzle which is covered by the joint member selectively connected by the connecting member, wherein, in the step of operating, each joint member covers a corresponding one of the discharge nozzles in a state of being selectively connected by the connecting member, and does not operate to cover a corresponding one of the discharge nozzles in a state of not being selectively connected by the connecting member.

6. The method according to claim 5, wherein the discharge head comprises electrothermal transducers which generate heat energy for liquid discharge.

7. The method according to claim 5, wherein in the step of controlling, the suction unit is controlled to suction liquid in each of the discharge nozzles by applying a pressure difference between a supply port and a discharge port of each discharge nozzle which is covered by the joint member selectively connected by the connecting member.

8. The method according to claim 5, further comprising a step of discharging the liquids from the discharge nozzles to a to-be-printed member.

* * * * *